US006547617B1

(12) United States Patent
Kawamura et al.

(10) Patent No.: US 6,547,617 B1
(45) Date of Patent: Apr. 15, 2003

(54) PLASMA DISPLAY PANEL MANUFACTURING METHOD FOR MANUFACTURING A PLASMA DISPLAY PANEL WITH SUPERIOR PICTURE QUALITY, A MANUFACTURING APPARATUS AND A PHOSPHOR INK

(76) Inventors: Hiroyuki Kawamura, 5-28-9, Fujigao, Katano-shi, Osaka 576-0022 (JP); Shigeo Suzuki, 2-9-1-315, Higashinakafuri, Hirakata-shi, Osaka 573-0093 (JP); Masaki Aoki, 5-12-1, Aoshinke, Minoo-shi, Osaka 562-0024 (JP); Kanako Miyashita, 1-24-11, Saigoutori, Moriguchi-shi, Osaka 570-0034 (JP); Mitsuhiro Ohtani, 3-8-31, Kouryounakamachi, Sakai-shi, Osaka 590-0024 (JP); Hiroyuki Kado, 1-15-34-107, Niitaka, Yodogawaku, Osaka-shi, Osaka 532-0033 (JP); Keisuke Sumida, 71-18-102, Sakuragaoka, Hirakata-shi, Osaka 573-0018 (JP); Nobuyuki Kirihara, 57-6, Nagaonishimachi 2-chome, Hirakata-shi, Osaka 573-0162 (JP)

( * ) Notice: Subject to any disclaimer, the term of this patent is extended or adjusted under 35 U.S.C. 154(b) by 0 days.

(21) Appl. No.: 09/743,171

(22) PCT Filed: Jul. 8, 1999

(86) PCT No.: PCT/JP99/03680

§ 371 (c)(1),
(2), (4) Date: Jan. 5, 2001

(87) PCT Pub. No.: WO00/03408

PCT Pub. Date: Jan. 20, 2000

(30) Foreign Application Priority Data

| | | |
|---|---|---|
| Jul. 8, 1998 | (JP) | 10-192541 |
| Sep. 9, 1998 | (JP) | 10-255002 |
| Oct. 9, 1998 | (JP) | 10-287643 |
| Oct. 9, 1998 | (JP) | 10-287645 |
| Jan. 27, 1999 | (JP) | 11-17855 |
| Mar. 30, 1999 | (JP) | 11-88717 |

(51) Int. Cl.[7] ..... H05D 5/06
(52) U.S. Cl. ..... 445/24; 427/68
(58) Field of Search ..... 445/24; 427/68

(56) References Cited

U.S. PATENT DOCUMENTS 4,267,204 A * 5/1981 Tomita et al. ..... 427/68

(List continued on next page.)

FOREIGN PATENT DOCUMENTS

EP 0 834 899 4/1998

(List continued on next page.)

*Primary Examiner*—Kenneth J. Ramsey

(57) ABSTRACT

The present invention intends to provide a manufacturing method for a PDP that can continuously apply phosphor ink for a long time and can accurately and evenly produce phosphor layers even when the cell construction is very fine. To do so, phosphor ink is continuously expelled from a nozzle while the nozzle moves relative to channels between partition walls formed on a plate so as to scan and apply phosphor ink to the channels. While doing so the path taken by the nozzle within each channel between a pair of partition walls is adjusted based on position information for the channel. When phosphor particles is successively applied to a plurality of channels, phosphor ink is continuously expelled from the nozzle even when the nozzle is positioned away from the channels. The phosphor ink is composed of: phosphor particles that have an average particle diameter of 0.5 to 5 $\mu$m; a mixed solvent in which materials selected from a group consisting of terpineol, butyl carbitol acetate, butyl carbitol, pentandiol, and limonene are mixed; and a binder that is an ethylene group polymer or ethyl cellulose containing at least 49% of ethoxy group ($—OC_2H_5$) cellulose molecules. After dispersion a charge-removing material is added to the phosphor ink.

4 Claims, 18 Drawing Sheets

U.S. PATENT DOCUMENTS

| | | | | |
|---|---|---|---|---|
| 5,158,491 | A | * 10/1992 | Fendley et al. | 445/52 |
| 5,921,836 | A | 7/1999 | Nanto et al. | |
| 6,046,539 | A | * 4/2000 | Haven et al. | 430/7 |

FOREIGN PATENT DOCUMENTS

| | | |
|---|---|---|
| EP | 884754 | 12/1998 |
| JP | 575785 | 1/1982 |
| JP | 5849433 | 3/1983 |
| JP | 63111970 | 5/1988 |
| JP | 63289741 | 11/1988 |
| JP | 462740 | 2/1992 |
| JP | 4273244 | 9/1992 |
| JP | 895239 | 4/1996 |
| JP | 82212925 | 8/1996 |
| JP | 1027543 | 1/1998 |
| JP | 10152680 | 6/1998 |
| JP | 10154466 | 6/1998 |
| JP | 10 223138 | 8/1998 |
| JP | 10233163 | 9/1998 |
| JP | 117890 | 1/1999 |
| JP | 11 040065 | 2/1999 |
| JP | 11 135017 | 5/1999 |
| JP | 11 162347 | 6/1999 |

* cited by examiner

PLASMA DISPLAY PANEL MANUFACTURING METHOD FOR MANUFACTURING A PLASMA DISPLAY PANEL WITH SUPERIOR PICTURE QUALITY, A MANUFACTURING APPARATUS AND A PHOSPHOR INK

TECHNICAL FIELD

The present invention relates to a manufacturing method for a plasma display panel, and in particular to improvements to a phosphor ink used to form the phosphor layer and to a phosphor ink applying device.

BACKGROUND ART

In recent years, there have been high expectations for the realization of large-screen televisions with superior picture quality. One example of such televisions are televisions for the "HiVision" standard used in Japan. In the field of display devices, research is being performed into a variety of devices, such as CRTs (Cathode Ray Tubes), LCDs (Liquid Crystal Displays), and Plasma Display Panels (hereafter PDPs) with the aim of producing suitable televisions.

Cathode ray tubes that are conventionally used in televisions have superior resolution and picture quality. However, the depth and weight of CRT televisions increases with screen size, so that CRTs are not suited to the production of large televisions with screen sizes of forty inches or more. LCDs have some notable advantages, such as low power consumption and low driving voltages, but it is difficult to manufacture large-screen LCDs.

On the other hand, PDPs enable large-screen slimline televisions to be produced, with fifty-inch models already having been developed.

PDPs can be roughly divided into direct current (DC) types and alternating current (AC) types. At present, AC types, which are suited to the production of panels with fine cell structures, are prevalent.

A representative AC-type PDPs is described hereafter. Display electrodes are provided on a front cover plate. This cover plate is arranged in parallel with a back cover plate on which the address electrodes are provided, so that the sets of electrodes form a matrix. A gap left between the plates is partitioned by partition walls in the form of stripes. Layers of red, green, and blue phosphors are formed between the partition walls and discharge gas is sealed in these spaces. Driving circuits are used to apply voltages to the electrodes, which causes discharge and the emission of ultra-violet light. This ultra-violet light is absorbed by the particles of red, green land blue phosphors in the phosphor layers, which causes excited emission of light. This light forms an image on the panel.

Most PDPs of this type are manufactured by forming the partition walls on the back plate, forming the phosphor layers between these walls, and introducing the discharge gas after arranging the front cover plate on the back plate.

Japanese Laid-Open Patent Application No. H06-5205 teaches a commonly used method for forming the phosphor layers between the partition walls. In this method (a screen-printing method), the gaps between the partition walls are filled with phosphor paste which is then baked. However, it is difficult to produce a PDP with a fine cell structure using screen printing.

As one example, when producing a television that is fully compatible with the specification for Japanese "HiVision" broadcasts, screen resolution needs to be 1920 by 1125 pixels, so that the pitch (cell pitch) of the partition walls for a 42-inch screen is only around 0.1 to 0.15 mm and the gaps between partition walls are only around 0.08 to 0.1 mm wide. Since the phosphor inks used by screen-printing is highly viscose (generally in the region of tens of thousands of centipoise), it is difficult to apply the phosphor inks to the narrow gaps between partition walls accurately and at high speed. It is also difficult to produce the screen plates for a PDP of such a fine construction.

Aside from screen printing, phosphor layers can be formed using a photoresist film or ink-jet printing.

One example of a method that uses a photo-resist film is described in Japanese Laid-Open Patent Application No. H06-273925. In this method, resinous film that is sensitive to UV light and contain phosphors of the one of the three colors is placed between adjacent partition walls. Only parts of the resinous film that are used to form a phosphor layer of the desired color are exposed, and remaining parts are washed away. With this method, a film can be inserted between the partition walls with a fair degree of accuracy, even when the cell pitch is narrow.

However, for each of the three colors, a film has to be inserted, the desired parts of the film need to be exposed, and the remaining parts need to be washed away. This makes the manufacturing process difficult, with there being a further problem of the different colors often becoming mixed. Phosphors are a relatively expensive material and since the phosphors that are washed away are unsuited to recycling, this method is also costly.

Japanese Laid-Open Patent Application Nos. S53-79371 and H08-162019 teach techniques that use ink-jet printing. A liquid ink formed of phosphors and an organic binder is pressurized and so is expelled from a nozzle that scans an insulating board, thereby forming a desired pattern of phosphor ink on the surface. These ink-jet methods generally use phosphor inks that are manufactured in the following way. Phosphors are dispersed in a mixture including (1) an organic binder such as ethyl cellulose, acryl resin, or polyvinyl alcohol, (2) a solvent such as terpineol or butyl carbitol acetate using a disperser such as a paint shaker.

With this kind of ink jet method, ink can be accurately applied to the narrow channels between the partition walls, though the ink that is expelled from the nozzle tends to form droplets and so is only intermittently applied to the channels. As a result, it is difficult to apply ink smoothly along the stripe-like channels.

In Japanese Laid-Open Patent Application Nos. H08-245853 and H09-253749, the inventors of the present application describe a method where low-viscosity, highly fluid phosphor inks are used. These inks are pressurized and so are continuously expelled from a moving nozzle, thereby applying the inks smoothly.

However, if the phosphor inks have been applied in the above manner, blurred lines tend to appear along the partition walls and along the gaps in the address electrodes when the resulting PDP is driven. Such blurred lines are especially evident in areas of the screen where white is being displayed.

It is believed that such blurred lines appear due to inconsistencies in the phosphor layers formed in the channels or due to the mixing of different-colored phosphors. Inconsistencies appear in the phosphor layer for the reasons given below.

(1) During application, the phosphor ink becomes electrically charged, and so can be affected by electrical charge that builds up due to the manufacturing environment or conditions. This means that the amount of phosphor ink that is applied can vary at different positions on the PDP.

(2) If the phosphor inks of the three colors are applied one at a time in order, the phosphor inks for the second and third colors are applied with phosphor ink already present in the neighboring channels. Phosphor ink being applied is subject to rheological effects of the phosphor ink present in these neighboring channels, so that it is difficult to apply the ink evenly.

Note that if the phosphor ink of each color is allowed to dry properly before the next ink is applied, such rheological effects can be eradicated. However, the drying process has to be performed more often, making more equipment necessary and complicating the manufacturing process.

(3) When phosphor ink is applied in the channels between the partition walls, it is preferable for the nozzle to scan along the centers of the channels so as to apply the ink eyenly. However, even if the nozzle moves in a straight line, inconsistencies in the width of the channels and curvature of the channels can prevent the nozzle from following the center of the channels, making the consistent application of ink extremely difficult. This problem is especially evident with PDPs that have a fine cell structure.

(4) If a highly fluid phosphor ink is applied using fine nozzle, the switching on and off of the nozzle is accompanied by variation in the amount of ink that is actually expelled from the nozzle and in the angle at which the ink jet emerges. This makes it difficult to accurately apply the phosphor ink between the partition walls.

As another problem, it is difficult to apply the phosphor ink to the side faces of the partition walls on both sides of the channels, so that the ink tends to accumulate at the base of the channels. A balanced application of phosphor ink to both the base and the side faces of the walls is therefore difficult to achieve. When the balance between the amounts of phosphor ink on the side faces of the walls and in the base is poor, high panel luminance is difficult to achieve.

The diameter of the nozzle used in inkjet methods needs to be small in keeping with the pitch of the partition walls. This makes it easy for the nozzle to become blocked and prevents the prolonged continuous application of phosphor ink. In particular, when making a highly intricate PDP with a partition wall pitch of 0.15 mm or below, the diameter of the nozzle has to be set at a narrower distance, making blockage of the nozzle more common.

DISCLOSURE OF INVENTION

The present invention intends to provide a manufacturing method for a PDP that can continuously apply phosphor ink for a long time and can accurately and evenly produce phosphor layers even when the cell construction is very fine, and to provide an ink application apparatus and phosphur inks suited to this manufacturing method. These allow PDPs with little line blurring at high resolutions and with high panel luminance to be produced.

To do this, the present invention has phosphur ink continuously expelled from a nozzle that moves relative to a plate so as to scan the plate with the nozzle following the channels between partition walls provided on the plate to apply phosphur ink to the channels. While scanning, the path taken by the nozzle within each channel is adjusted in accordance with position information for each channel.

As a result, even when the channels are curved, the nozzle kept moving along the center of each channel, so that phosphur ink can be evenly applied to each channel and can be applied with a favorable balance between the side faces of the partition walls and the bottoms of the channels.

The present invention has phosphur ink continuously expelled from a nozzle that moves relative to a plate so as to scan the plate with the nozzle following the channels between partition walls provided on the plate to apply phosphur ink to the channels. The width of each channel is measured all along the channels and the amount of phosphur ink expelled by the nozzle and applied per unit length of the partition walls is adjusted based on the width of the present channel.

As a result, phosphur ink can be applied evenly, even when there are differences in widths between channels or fluctuations in the width of the same channel.

With the present invention, when phosphur ink is applied successively to a plurality of channels, phosphur ink is continuously expelled from the nozzle even when the nozzle is positioned away from the channels. As a result, ink does not build up near the rim of the nozzle, ensuring that a consistent ink jet can be produced. This enables phosphur ink to be applied evenly to a plurality of channels.

Before having the phosphur ink continuously expelled from the nozzle, the phosphur ink can have the ink redispersed in a disperser. This improves the dispersion of the phosphur particles in the phosphur ink and enbles the phosphur ink to be applied with a favorable balance between the phosphur the side faces of the partition walls and the bottoms of the channels.

The phosphur ink used by the present invention in the manufacture of a PDP is composed of: phosphor particles that have an average particle diameter of 0.5 to 5 $\mu$m; a mixed solvent in which materials are selected from a group of solvents having a hydroxide group terminal are mixed, the group including terpineol, butyl carbitol acetate, butyl carbitol, pentandiol, and limonene; a binder that is an ethylene group polymer or ethyl cellulose (cellulose molecules in which the hydroxide group (—OH) has been replaced with a ethoxy group) containing at least 49% of ethoxy group (—$OC_2H_5$) cellulose molecules; and a dispersant. The contained amount of ethoxy group referred to here is the amount of ethoxy group in the cellulose molecules. As one example when the all of the hydroxide groups in the cellulose are replaced with ethoxy group, the contained amount of ethoxy group is 54.88%.

The viscosity of the phosphur ink may be set at a low value that is 2000 centipoise or below. A viscosity in a range of 100 to 500 centipoise is preferable.

In a phosphur ink that is conventionally used in a PDP, a resinous material such as ethyl cellulose series, acryl series, os polyvinyl alcohol series is used as a binder. Terpineol and butyl carbitol are also conventionally used in such phosphur inks are solvents, though such binders with insufficiently dissolve in such solvents, resulting in problems regarding the dispersion of the phosphur ink and the resin.

On the other hand, the phosphur ink of the present invention uses the only the specific types of binder and solvents given above. This ensures that the binder favorably dissolves in the solvent, which improves the dispersion of the phosphur particles. As a result, phosphur ink that has been introduced into a channel between a pair of partition walls will favorably adhere to the side faces of the partition walls and that the phosphur ink is less susceptible to the rheologically effects of phosphur ink being present in adjacent channels. As a result, phosphur ink can be applied with a favorable balance between the amount of ink on the side faces of the partition walls and the amount of ink in the bottom of the channels.

The following are examples of preferred dispersants that can be added to the phosphur ink an anionic surface-active agent selected from: salts of fatty acids; alkyl sulfate; ester salts; alkyl benzene sulfonate, alkyl sulfosuccinate, naphthalene sulfonic polycarboxlic polymer, a non-ionic surface-active agent selected from: polyoxy ethylene alkyl ester, polyoxy ethylene derivatives, sorbiton fatty ester, glycerol fatty acid ester and polyoxy ethylene alkyl amine, or a cationic surface-active agent selected from: an alkylamine salt, quarternary ammonium salt, alkyl betaine, and amin oxide.

A charge-removing material may also be added to the phosphur ink of the present invention that is to be used in the manufacturing of PDPs.

As a result phosphur ink can be applied evenly to the channels between partition walls, even when a PDP has a very fine construction. When the resulting PDP is driven, little line blurring is observed. It is believed that if charge-removing material and dispersant are added to a phosphur ink, the phosphur ink does not become electrically charged during application, which stops the phosphur ink from rising up.

Fine particles of a conductive material, such as fine particles of any of carbon, graphite, metal, or a metal oxide, or a surface-sctive agent such as those given earlier as surface-active agents may be used as the charge-removing material.

If the added charge-removing material has properties whereby baking removes the charge-removing material or removes the conductivity of the charge-removing material, like a surface-active agent or fine particles of carbon, the driving of the resulting PDP will not be affected by the presence of any charge-removing material in the phosphur layer.

BRIEF DESCRIPTION OF DRAWINGS

FIG. 5A is an enlargement of part of FIG. 4, while

FIG. 4 is enlarged.

BEST MODE FOR CARRYING OUT THE INVENTION

First Embodiment

Overall Construction and Manufacturing Method of a PDP

Figure 1:
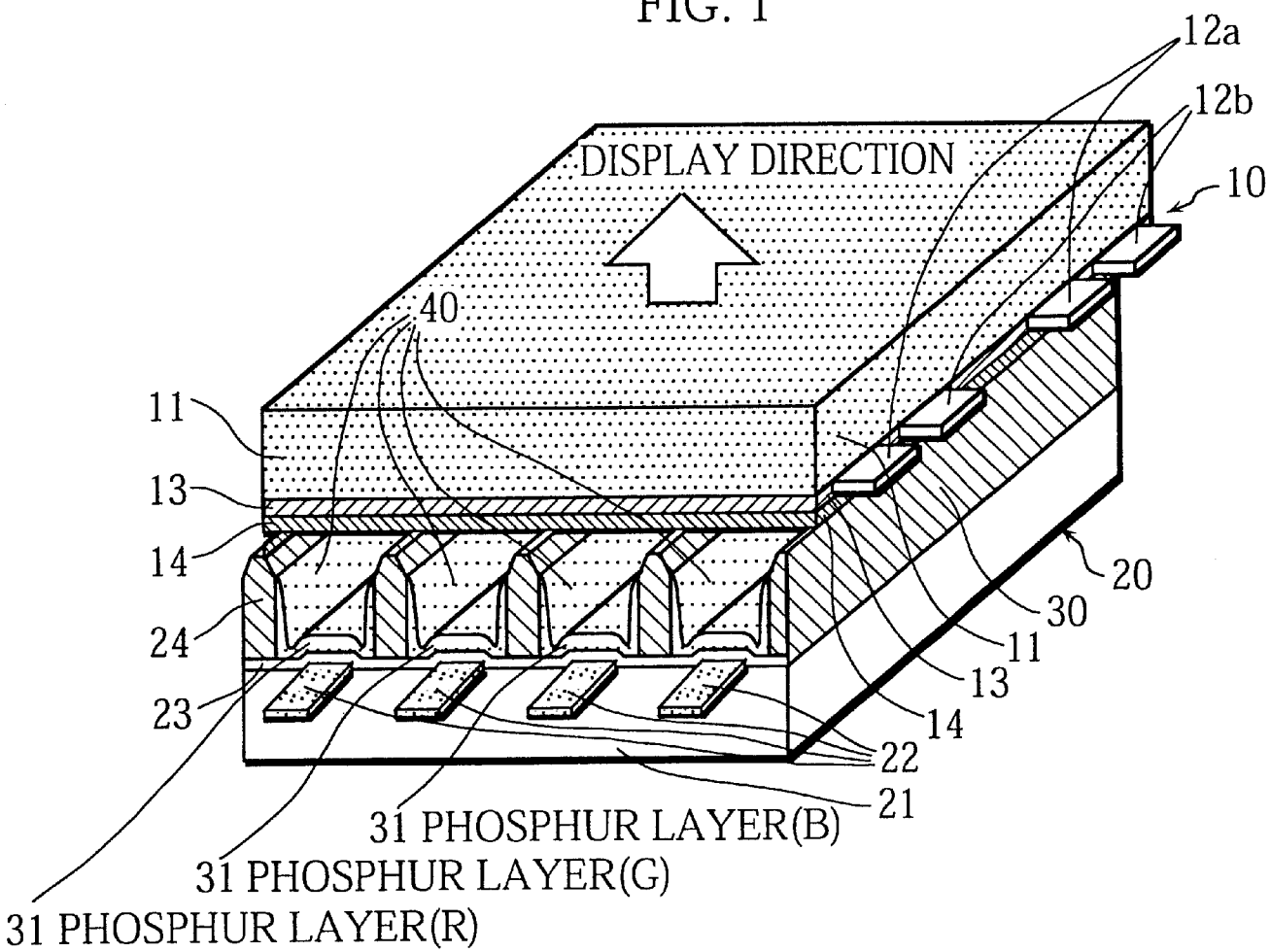
FIG. 1 is a perspective drawing of an AC surface-discharge type PDP to which the embodiments relate.
Figure 2:
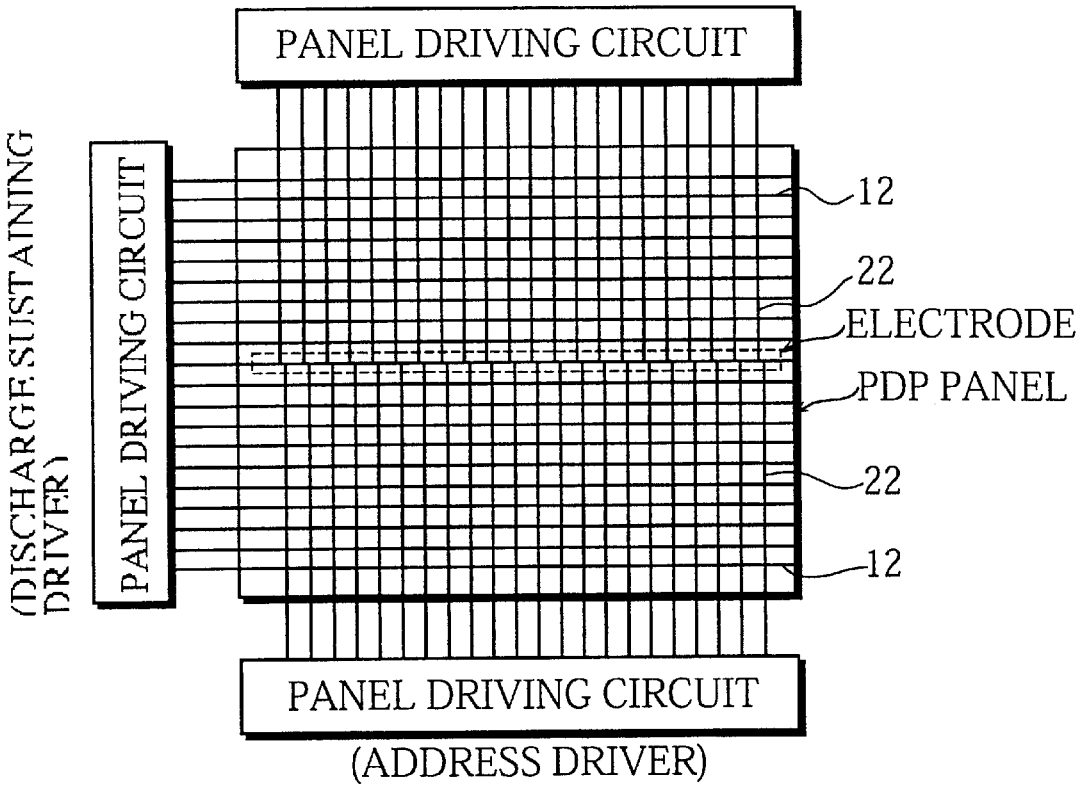
FIG. 2 show the construction of a display apparatus that includes the above PDP in a circuit block.

FIG. 1 is a perspective drawing of an AC surface discharge-type PDP that is a first embodiment of the present invention. FIG. 2 shows a display apparatus that has a circuit block attached to this PDP.

This PDP is fundamentally composed of a front panel 10 and a back panel 20. The front panel 10 is formed with discharge electrodes 12 (scanning electrodes 12*a* and sustain electrodes 12*b*), an inductor layer 13, and a protective layer 14 on a front glass substrate 11. The back panel 20 is formed with address electrodes 22 and an inductor layer 23 on a back glass substrate 21. The front panel 10 and back panel 20 are arranged in parallel with the address electrodes 22 facing the scanning electrodes 12*a* and sustain electrodes 12*b* with a gap between them. Partition walls 30 are formed as stripes in the gap between the front panel 10 and back panel 20 to form partitions that serve as the discharge spaces 40. Discharge gas is introduced into these discharge spaces.

Phosphor layers 31 are formed on the back panel 20 in the discharge spaces 40. These phosphor layers 31 are provided in the form of alternating red, green and blue stripes.

The discharge electrodes 12 and address electrodes 22 are both in the form of stripes. The discharge electrodes 12 run perpendicular to the partition walls 30, while the address electrodes 22 run parallel to the partition walls 30.

Note that in FIG. 2, the discharge electrodes 12 are shown as being continuous and as running across the entire width of the panel from one side to the other. However, each address electrode 22 is divided in the center of the panel and the panel is driven using a dual scan method.

The discharge electrodes 12 and address electrodes 22 can be formed of a single metal, such as silver, gold, copper, chromium, nickel, or platinum. However, it is preferable for the discharge electrodes 12 to be formed of a fine silver electrode arranged on top of a wide transparent electrode made a conductive metal oxide such as ITO, $SnO_2$, or ZnO, since this increases the discharge area in each cell.

The panel is produced with cells that emit red, green, or blue light positioned at the intersections of the discharge electrodes 12 and the address electrodes 22.

The inductor layer 13 is a layer of an inductor material that is formed over the entire surface of the front glass substrate 11 on which the discharge electrodes 12 are arranged. While low-melting point lead glass is often used for this inductor layer 13, bismuth low-melting point glass or a laminate of lead glass with a low-melting point and bismuth glass with a low-melting point may be used.

The protective layer 14 is a magnesium oxide (MgO) film that covers the entire surface of the inductor layer 13.

The inductor layer 23 also functions as a reflective layer for light of the visible spectrum, and so contain particles of $TiO_2$.

The partition walls 30 are formed of a glass material, and are shaped so as to protrude upwards on the surface of the inductor layer 23 of the back panel 20.

Manufacturing Method for the PDP

The following describes the manufacturing method of the present PDP.

Front Panel

The front panel 10 is produced by forming the discharge electrodes 12 on top of the front glass substrate 11. A zinc-based inductor layer 13 is then formed on top of the front glass substrate 11 and discharge electrodes and a protective layer 14 is then formed on the inductor layer 13.

The discharge electrodes 12 are made of silver, and are formed by applying a silver electrode paste using screen-printing and then baking the electrode paste. As alternatives, these discharge electrodes 12 can be formed by an inkjet or photo-resist method.

As one example, the inductor layer 13 can be produced as follows. A composite where 70% by weight of lead oxide (PbO), 15% by weight of boron oxide ($B_2O_3$), 10% by weight of silicon oxide ($SiO_2$) and 5% by weight of aluminum oxide are mixed with an organic binder (where α-terpineol is dissolved in ethyl cellulose) is applied using screen printing. This is then baked at 520° C. for twenty minutes to produce a layer that is approximately 20 μm thick.

The protective layer 14 is formed of magnesium oxide (MgO). This is usually formed using sputtering, though in the present case CVD (Chemical Vapor Deposition) is used to form a film that is 1.0 μm thick.

To form a magnesium oxide protective layer using CVD, the front glass substrate 11 is set inside a CVD apparatus. A magnesium compound, which is used as the source, and oxygen are supplied and made to react with one another. As specific examples, the magnesium compound used as the source may be magnesium acetyl acetone ($Mg(C_5H_7O_2)_2$) or magnesium cyclopentadienyl ($Mg(C_5H_5)_2$).

Back Panel

Like the discharge electrodes 12, the address electrodes 22 are formed on the back glass substrate 21 by screen-printing.

Next, a glass material containing $TiO_2$ particles is screen printed and baked to form the inductor layer 23. After this, glass material is repeatedly applied using screen printing, and this is baked to form the partition walls 30.

The phosphor layer 31 is formed in the channels between the partition walls 30. This process is described in detail later, but is basically performed by having phosphor ink continuously ejected from a nozzle that scans along the channels to apply the ink. The phosphor layer 31 is then completed by baking to remove the solvent and binder included in the phosphor ink.

In order to have phosphors adhere to the side walls of the partition walls 30 when the phosphor ink dries, the material used for forming the partition walls 30 should be selected so as that the contact angle between the phosphor ink and the sides of the partition walls 30 is lower than the contact angle between the side walls and the base of the channels.

In the present embodiment, the partition walls 30 have a height of 0.1 to 0.15 mm and a pitch of 0.15 to 0.36 mm, in keeping with the requirements for a 40-inch VGA or HiVision television.

Assembly of the PDP by Bonding the Panels Together

The front panel and back panel produced by the above methods are bonded together using sealant glass. At this point, the discharge spaces 40 that are separated by the partition walls 30 are evacuated to produce a high vacuum (such as $8*10^{-7}$ Torr). After this, discharge gas (such as an inert gas like an He—Xe mixture or an Ne—Xe mixture) is introduced into the discharge space 40 at a specified pressure to complete the manufacturing of the PDP.

Note that in the present embodiment, the discharge gas includes at least 5% of xenon by volume and is introduced with a gas pressure in a range of 500 to 800 Torr.

The PDP is driven having been connected to a circuit block, like the one shown in FIG. 2.

Phosphor Ink, Ink Application Apparatus and Application Method

The phosphor inks are formed by dispersing particles of different-colored phosphors into a mixture of binder, solvent and dispersant. The viscosity of the phosphor inks is adjusted to a suitable level.

Materials that are usually used to form the phosphor layer in a PDP can be used as these phosphor particles. Several specific examples are given below.

Blue phosphor: $BaMgAl_{10}O_{17}:Eu^{2+}$

Green phosphor: $BaAl_{12}O_{19}:Mn$ or $Zn_2SiO_4:Mn$

Red phosphor: $(YxGd_{1-x})BO_3:Eu^{3+}$ or $YBO_3:Eu^{3+}$

The composition of the phosphor inks is described in detail later.

Figure 3:
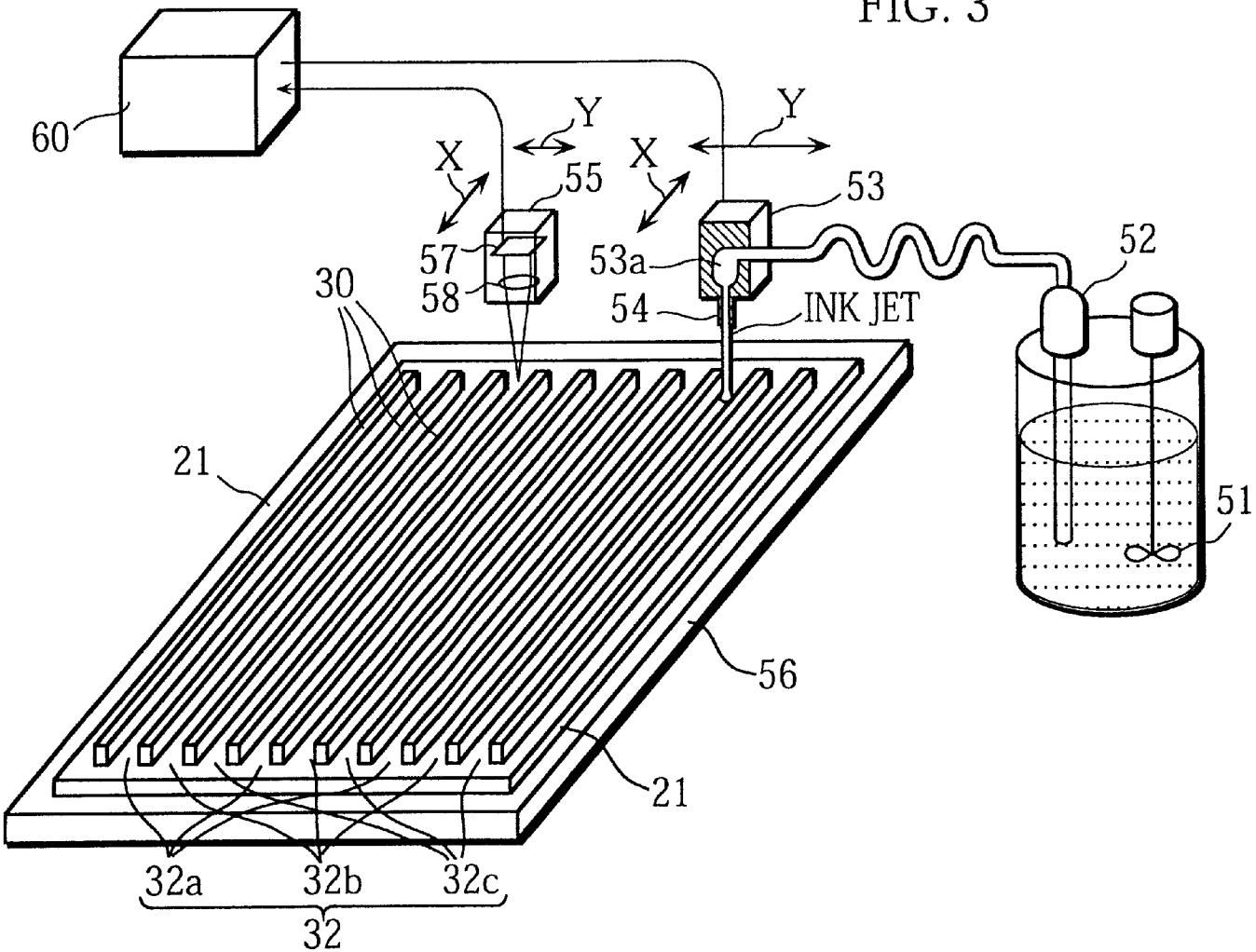
FIG. 3 is a simplified drawing showing the construction of an ink application apparatus to which the first embodiment relates.

FIG. 3 shows the overall construction of the ink application apparatus 50 used to form the phosphor layer 31.

As shown in FIG. 3, the ink application apparatus 50 includes an ink server 51, a pressurizing pump 52, a nozzle head 53, aplate support 56, and a channel detecting head 55. The ink server 51 holds phosphor ink. The pressurizing pump 52 pressurizes the phosphor ink in the ink server 51 so as to transport the phosphor ink. The nozzle head 53 is used for emitting a jet of phosphor ink that has been transported by the pressurizing pump 52. The plate support 56 is used for supporting the plate (the back glass substrate 21 on which the partition walls 30 have been formed in stripes). The channel detecting head 55 detects the position of the channels 32 (i.e., the gaps between adjacent partition walls 30) on the back glass substrate 21 that has been placed on the plate support 56.

The back glass substrate 21 is placed on the plate support 56 in the ink application apparatus 50 with the partition walls 30 aligned with the direction shown as X in FIG. 3.

A driving mechanism (not illustrated) for driving the nozzle head 53 and channel detecting head 55 relative to the plate support 56 is also provided. In accordance with instructions from the controller 60, the driving mechanism drives the nozzle head 53 and channel detecting head 55 across the surface of the plate support 56 to scan in the X direction and Y direction. The driving mechanism can be a feeding screw mechanism, like that used in a triaxial robot, a linear motor, or an air cylinder mechanism, and can drive the nozzle head 53 and channel detecting head 55 or alternatively the plate support 56. A specific example of the driving mechanism is described in the second embodiment.

A position detection mechanism (not illustrated) is also provided for detecting the position in the X and Y axes (i.e., the X and Y coordinates) of the nozzle head 53 and channel detecting head 55 above the plate support 56, with the controller 60 being capable of detecting the coordinate position of these components. A linear sensor may be provided as the position detection mechanism, though when a driving mechanism, such as a pulse motor, that can accurately control the driving amount is used in the X direction axis and/or Y-axis, a base position detecting sensor may be provided for detecting when the components pass a base position in the X-axis and/or Y-axis, with the position in the X-axis and/or Y-axis being found from the driving amount of the driving mechanism.

The nozzle head 53 is produced by machining and electrical discharge machining a metal material to form an integral body including an ink chamber 53*a* and a nozzle 54.

The phosphor ink supplied by the pressurizing pump 52 is temporarily held in the ink chamber 53*a* and a continuous jet of ink is expelled by the nozzle 54.

It is assumed here that only one nozzle 54 is provided in the nozzle head 53, though if a plurality of nozzles 54 are provided, a plurality of ink jets can be produced. In this case, the pressure applied to each nozzle 54 is equalized when the phosphor ink is supplied to the ink chamber 53*a*.

As described later with reference to FIG. 11, the hole diameter of the nozzle 54 needs to be considerably smaller than the pitch of the partition walls so that the ink jet does not overshoot the channels between the partition walls. However, it is also necessary to avoid blockages of the nozzle. In most cases, the diameter is set in a range of around several tens to several hundreds of micrometers, though this may change depending on factors such as the amount of phosphor ink that is expelled from the nozzle.

The ink server 51 is provided with an agitator 51*a* to stop the particles (such as the phosphor particles) in the phosphor ink settling.

The channel detecting head 55 scans the surface of the back glass substrate 21 that is placed on the plate support 56 and measures the characteristics (such as the amount of light reflected off the surface or the inductance of the surface) of different positions on the surface. Based on the measurements made by the channel detecting head 55, position information is obtained for each channel 32 on the back glass substrate 21.

As shown in FIG. 3, the channel detecting head 55 includes a CCD line sensor 57 that extends in the Y-axis and a lens 58 that projects light reflected back off the upper surface of the back glass substrate 21 onto the CCD line sensor 57. Image data is accumulated for the upper surface of the back glass substrate 21 in the Y-axis of the CCD line sensor 57 and is transferred to the controller 60.

Channel Position Detection and Application of Ink by the Ink Application Apparatus 50

Using this kind of ink application apparatus 50, position information can be obtained for the channels 32*a*, 32*b*, and 32*c* between the partition walls. Based on this position information, the position of the nozzle head 53 within the channels can be controlled so that phosphor inks of each color can be respectively applied to the channels 32*a*, 32*b*, and 32*c*. A specific example of this operation is described below.

First the back glass substrate 21 is placed on the plate support 56. The channel detecting head 55 repeatedly scans and photographs the back glass substrate 21 in the X-axis, moving slightly in the Y-axis between scans. As a result, image data for the entire surface of the back glass substrate 21 is sent in order to the controller 60. The controller 60 receives the image data sent from the channel detecting head 55 and stores the image data in a memory so that the detected luminance of each position is stored corresponding to coordinates for the position on the plate support 56.

Figure 4:
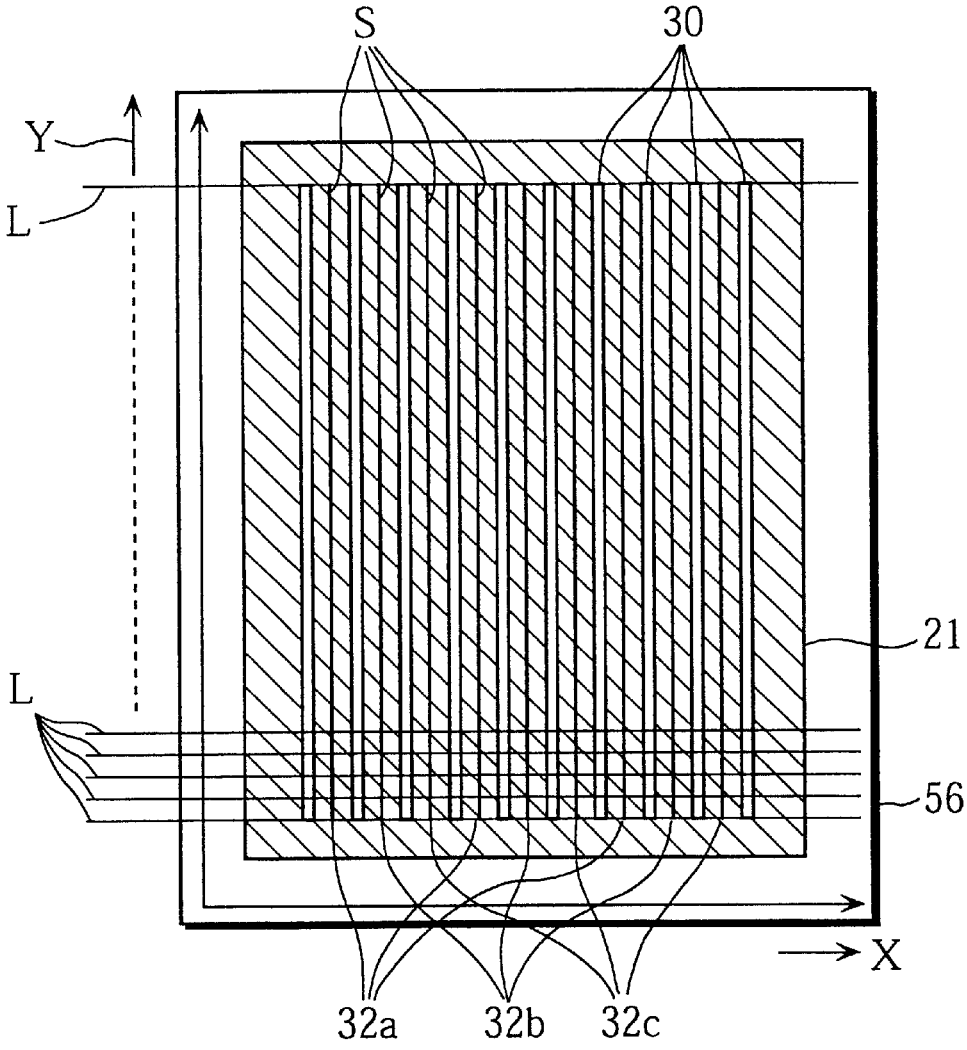
FIG. 4 is a representation of the image data obtained by the ink application apparatus of the first embodiment when the positions of the channels are detected.

FIG. 4 is a representation of the image data obtained in this way. In FIG. 4, the diagonally shaded rectangle corresponds to the back glass substrate 21, and the non-shaded parts within this rectangle correspond to the upper surfaces of the partition walls 30.

Based on the obtained image data, the scanning lines are set next.

It is believed that the channels 32*a*, 32*b* and 32*c* between the partition walls 30 will have a different luminance value to the upper surfaces of the partition walls 30. In more detail, the channels will generally reflect less light than the upper surfaces of the partition walls, with these parts being demarcated in FIG. 4 as the diagonally shaded and non-shaded areas. Areas where there is a sudden change in luminance value can therefore be regarded as the edges of the channels 32*a*, 32*b*, and 32*c* (or in other words, the boundaries between the channels and the partition walls), so that the scanning lines S can be set in the middle of both edges of each of the channels 32*a*, 32*b*, and 32*c*.

The following describes the method for setting the scanning lines S in more detail.

In the image data shown in FIG. 4, a plurality of detection lines L are set with an equal pitch parallel to the Y-axis so as to cross the partition walls 30.

Figure 5A:
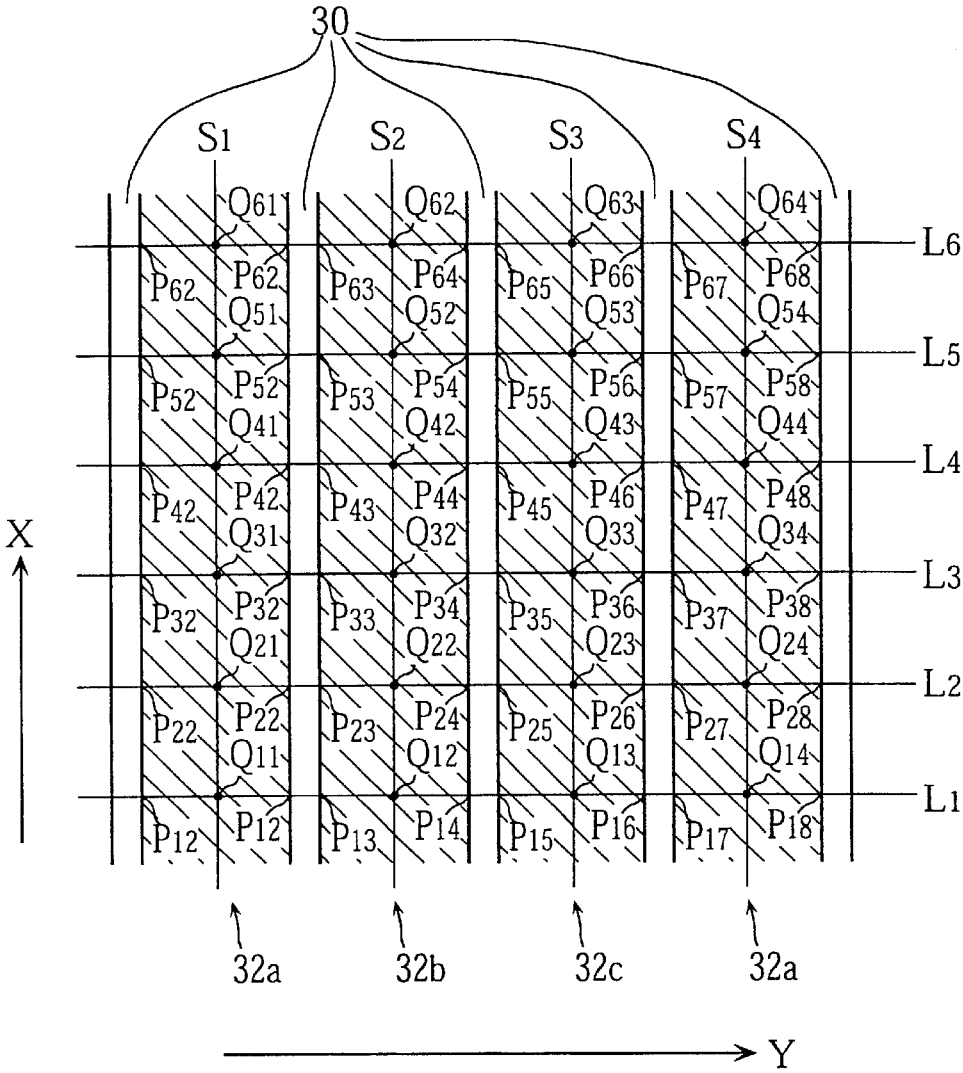

FIG. 5A is a partial enlargement of FIG. 4 in which he detection lines L1, L2, L3, . . . , L6 have been drawn.

Figure 5B:
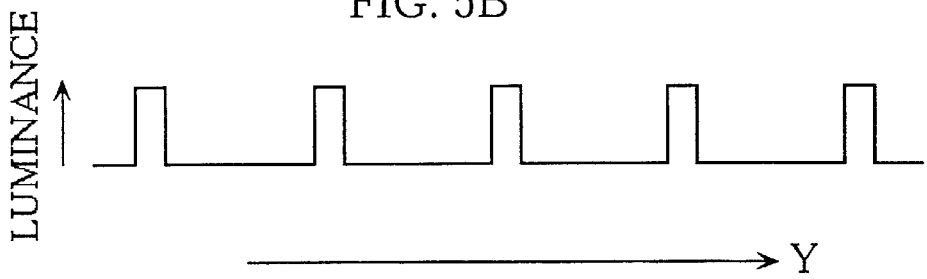
FIG. 5B is a graph showing the luminance at various positions on the detection line L1.

FIG. 5B is a graph showing a representation of the luminance of different positions on the detection line L1. This graph shows that the positions that correspond to the upper surfaces of the partition walls 30 have high luminance while the positions that correspond to the channels 32*a*, 32*b* and 32*c* have low luminance.

The Y coordinates of the points (P11, P12, P13, . . . P18) on the detection line L1 in FIG. 5A where there is a sudden change in luminance, or in other words, the points corresponding to a rising or falling edge in the graph of FIG. 5B, are found. In the same way, the Y coordinates of the points (P21, P22, P23, . . . , P28), the points (P31, P32, P33, . . . , P38). . . , and the points (P61, P62, P63, . . . , P68) on the detection lines L2, L3, . . . , L6 in FIG. 5A where there is a sudden change in luminance are found.

The coordinates of the midpoint Q11 of the points P11 and P12, the midpoint Q21 of the points P21 and P22, . . . , and the midpoint Q61 of the points P61 and P62 are calculated and the scanning line S1 is set for the leftmost channel 32*a* in FIG. 5A by joining these midpoints Q11, Q21, and Q61, Midpoints are joined in the same way for the second, third and fourth channels counting from the left in FIG. 5A to set the scanning lines S2, S3, and S4.

Once the scanning lines S have been set in this way, the nozzle 54 is made to follow each scanning line. By having phosphor ink of various colors ejected from the nozzle 54 as it moves in this way, phosphor ink can be applied to the channels 32*a*, 32*b* and 32*c*. This is described in more detail below.

First, phosphor ink that is one color (such as blue) selected from a group made up of blue, green, and red, is supplied to the ink server 51.

The controller 60 moves the nozzle head 53 to the end of the scanning line for first channel 32*a* where the ink is to be applied first. The controller 60 then activates the pressurizing pump 52 to have phosphor ink pumped to the nozzle head 53 and expelled as a continuous stream from the nozzle 54. The distance from the lower end of the nozzle 54 to the upper surface of the partition walls is set in accordance with conditions such as the amount of ink expelled from the nozzle, and is normally within a range of 0.5 to 3 mm.

The controller 60 has the nozzle head 53 move in the X direction, but also adjusts the position of the nozzle head 53 in the Y direction so that the nozzle 54 follows the set scanning line S.

The controller 60 next shifts the nozzle head 53 in the Y direction has the nozzle head 53 move to an end of a scanning line S in a next channel 32*a* to which ink is to be applied. The nozzle head 53 is then made to move back across the back glass substrate 21 at high speed while expelling phosphor ink, with the nozzle 54 following the scanning line S.

By repeatedly performing this operation, phosphor ink of the first color can be applied to all of the channels 32*a* on the back glass substrate 21.

Next, phosphor ink of a second color, such as green, is applied to the adjacent channels 32*b,* and phosphor ink of a third color, such as red, is applied to the adjacent channels 32*c*. In this way, phosphor inks of three colors are applied to the channels 32*a,* 32*b,* and 32*c*.

Figure 6A:
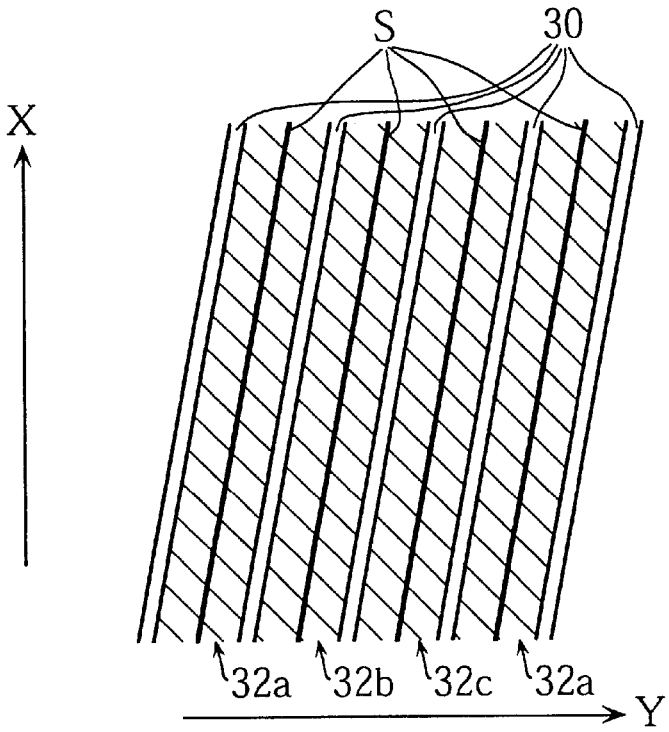
FIG. 6 is an example image that may be obtained when
Figure 6B:
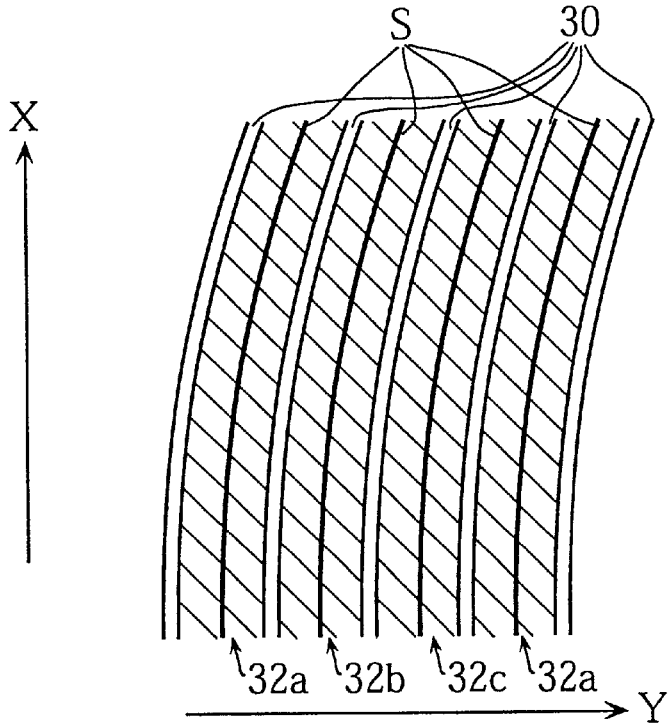

By applying phosphor ink to using the method described above, the scanning lines S can be set in the middle of the channels even when the channels 32*a,* 32*b,* and 32*c* are disposed at an angle as in FIG. 6A or are bent as shown in FIG. 6B. Since the nozzle 54 follows these scanning lines S, phosphor ink can be applied to the partition walls on both sides of the channels and can be applied evenly along the channels.

Figure 7A:
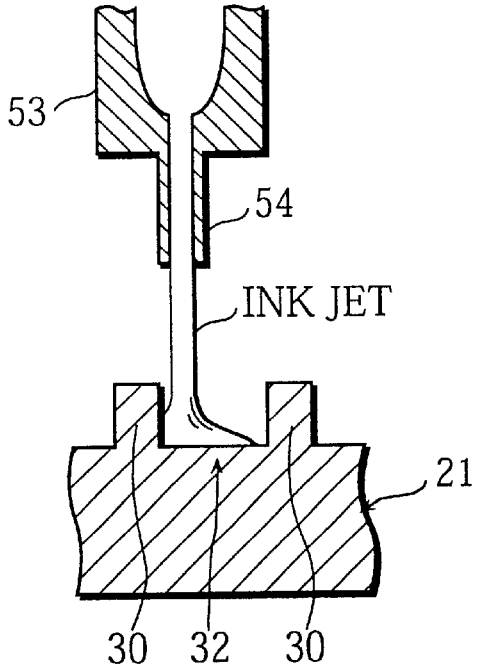
FIGS. 7A and 7B respectively show how phosphor ink is applied when the nozzle veers away from the center of a channel and the phosphor layer that is formed in this case.
Figure 7B:
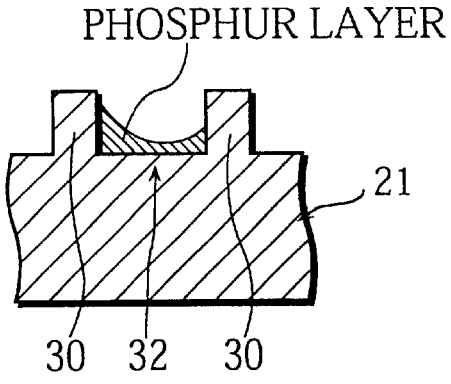

When the channels 32*a,* 32*b,* and 32*c* are disposed at an angle or are bent as shown in FIGS. 6A and 6B, if the nozzle 54 did not move in the Y-axis and instead simply traveled in a straight line that is parallel with the X-axis, the nozzle 54 would end up moving off-center, as shown in FIG. 7A, and so approach the partition wall on one side (the left side in FIG. 7A) of the channel. If the nozzle is positioned in this way, a large amount of phosphor ink tends to stick to the side face of one partition wall. The phosphor layer that is eventually formed in this case tends to be thick near a partition wall on one side of the channel.

In extreme cases, the nozzle 54 veers over in the next channel, in which case phosphor inks of different colors may be applied to the same channel. However, with the present method for applying phosphor inks, ink is applied evenly to both sides of every channel across the whole of the back glass substrate.

Note that the effect described above can be obtained even if the nozzle is not set directly above the set scanning lines, and instead scans the back glass substrate close the scanning lines.

Controlling the Amount of Phosphor Ink Expelled from the Nozzle

If the pitch of the partition walls 30 is constant and the width of each of the channels 32*a,* 32*b,* and 32*c* is also constant, the scanning speed of the nozzle and the amount of ink expelled from the nozzle (more specifically, the rate at which ink is expelled from the nozzle), can also be set at a constant level. However, when channels have different widths or there is variation in the width of the same channel, moving the nozzle at a constant scanning speed and expelling phosphor ink at a constant rate will result in inconsistencies in the application of phosphor ink (more specifically, inconsistencies in the amount of ink present on the base of the channels and the side faces of the partition walls). Application of phosphor ink at a constant rate results in less phosphor ink being applied to the side faces of the partition walls at positions where the channels are wide than is applied at positions where the channels are narrow.

In places where a channel is narrow, an excessive amount of phosphor ink is applied, which can lead to phosphor ink overflowing into adjacent channels and mixing with other colors of phosphor ink.

When the following method is used, the amount of pressure used to pump the phosphor ink to the nozzle or the scanning speed is changed in accordance with fluctuations in the width of a channel, thereby overcoming the above problem.

In the image data shown in FIG. 4, the width of each of the channels 32*a,* 32*b,* and 32*c* is measured along the detection lines. The amount of ink applied per unit length in the X-axis when the nozzle 54 scans the back glass substrate 21 is then adjusted proportionally to the channel width. This adjustment is achieved by controlling the amount of pressure applied by the pressurizing pump 52 or the driving speed of the X-axis driving mechanism.

As one example, for the scanning line S1 in FIG. SA, the channel widths at the points Q11 (i.e., the distance between the points P11 and P12), Q21, . . . , Q61 are measured. When the nozzle 54 is moved along the scanning line S1, the amount of pressure applied by the pressurizing pump 52 as the nozzle 54 passes the points Q11, Q21, . . . , Q61 is changed in proportion to the measured channel widths.

By performing this kind of control, the amount of phosphor ink applied per unit length in the X-axis can made roughly proportionate to the channel width. This means that phosphor ink can be evenly applied to channels without inks being mixed where the channels are narrow, even when there are differences in the widths of channels and fluctuations in the width of the same channel.

Modifications to the Methods for Obtaining Position Information for Channels and Driving the Nozzle In the above embodiment, the channel detecting head 55 forms an image of the entire upper surface of the back glass substrate 21, obtains position information for the channels from the resulting image data, and uses this position information to set the scanning lines. However, this is only one example of how the scanning lines can be set, and the present invention can use a variety of other methods.

As one example, a head that has a CCD (Charge Coupled Device) that extends in the X-axis may scan the back glass substrate 21 in the Y-axis so as to cross the partition walls 30 and detect points where there are changes in the amount of luminance. By detecting the luminance on lines that are equivalent to the detection lines L1, L2, . . . in FIG. 5A, points where the luminance changes can be detected and the scanning lines can be set in the same way as in the embodiment.

In the above embodiment, points where there are a sudden change in luminance are detected and are judged to correspond to the edges of the channels. However, as one example, a distance sensor may be provided on the channel detecting head 55. This channel detecting head 55 is made to scan the back glass substrate 21 as before, and points where there is a sudden change in detected distance are detected and are judged to correspond to the edges of the channels.

As an alternative, the channel detecting head 55 may be provided with a permittivity measuring sensor for measuring electrically permittivity. This channel detecting head 55 is made to scan the back glass substrate 21 as before, and points where there is a sudden change in permittivity are detected and are judged to correspond to the edges of the channels.

In the above embodiment, the ink application apparatus 50 is constructed with the nozzle head 53 and the channel detecting head 55 being driven separately. However, the operation described above can still be performed if these components are driven as a single component.

The above embodiment describes an example case where the ink application apparatus 50 scans the entire upper surface of the back glass substrate 21, detects the positions of the channels using the channel detecting head 55 and sets the scanning lines in advance before starting to apply the phosphor inks. However, these processes can be performed at the same time. In more detail, the image data for a channel to which ink is to be applied later can be obtained and a scanning line can be set while the nozzle head 53 is scanning the back glass substrate 21 to apply phosphor ink to a different channel. The nozzle head 53 is then controlled to follow the scanning line set in this way when applying phosphor ink to the later channel.

Putting this another way, the scanning lines only need to be set before they are followed by the nozzle head 53 to allow the nozzle head 53 to be controlled as described in the above embodiment and achieve the same effects described above.

As one example, the nozzle head 53 can be provided with a channel detector (a CCD line sensor) that detects the center position of a channel and is placed further up the channel in the scanning direction. As the nozzle head 53 scans the back glass substrate 21, the channel detector detects the center of a channel at a position that is ahead of the nozzle head 53, and the nozzle head 53 is controlled so as to pass this detected center of the channel. When this arrangement is used, however, the detection of the center of the channel and the driving of the nozzle head 53 in the Y-axis have to be performed at high speed.

As another alternative, a feedback correction system may be used. In such system, channel detector may be provided on the nozzle head 53, the center of a channel may be detected by this channel detector, the deviation of the nozzle head 53 from the center of the channel may be calculated, and the nozzle head 53 may be moved in the Y-axis so as to cancel out the deviation.

The above embodiment describes the case where the nozzle head 53 is provided with one nozzle 54, though the same effects can be achieved if the nozzle head 53 is provided with a plurality of nozzles 54.

In this case, the position of the nozzle head 53 in the Y-axis is adjusted so that each nozzle 54 follows a different scanning line. As one example, the nozzle pitch may be set at three times the pitch of the partition walls, and the scanning line to be followed by the nozzle head 53 may be set as the average of scanning lines set in the centers of the channels 32*a*. The position of the nozzle head 53 is then adjusted in the Y-axis so that the nozzle head 53 follows a head scanning line set in this way.

As a result, phosphor ink can be applied to a plurality of channels at the same time.

If the nozzle head 53 is only provided with one nozzle 54, the nozzle head 53 has to scan the back glass substrate 21 a number of times that is equal to the total number of channels 32*a*, 32*b*, and 32*c*. However, the higher the number of nozzles 54 on the nozzle head 53, the lower the number of passes to be made by the nozzle head 53. As one example, if the nozzle head 53 is provided with three nozzles 54, phosphor ink can be applied to three channels in a single scanning of the back glass substrate 21. It should be obvious that the number of times the nozzle head 53 needs to scan the back glass substrate 21 in this case is cut to ⅓ of the number of scans performed when only one nozzle 54 is used.

A high-resolution PDP has between several hundred and several thousand channels 32*a*, 32*b*, 32*c* on the back glass substrate 21. As examples, a 16:9 42-inch PDP display apparatus with VGA-level performance has around 850 lines of each color, while a similar monitor with HD (High Definition) performance has 1920 lines. This means that an increase in the number of nozzles 54 can greatly improve the efficiency with which a display apparatus is manufactured.

Also, while the above embodiment describes a method that only applies phosphor ink of a second color after completing the application of the phosphor ink of a first color, the ink application apparatus 50 may be provided with three nozzle heads that apply phosphor ink of the three colors, so that three colors of phosphor ink can be applied simultaneously.

Composition of the Phosphor Inks (1) Phosphor Particles

To avoid blockages of the nozzle(s) and settling of the phosphor particles, the phosphor particles used in the phosphor ink should have an average particle diameter of 5 $\mu$m or less. However, to produce a phosphor layer that efficiently produces light, the average particle diameter of the phosphor particles should be 0.5 $\mu$m or above. For these reasons, the phosphor particles should have an average particle diameter of 0.5 to 5 $\mu$m, with particles in a range of 2 to 3 $\mu$m being preferred.

To improve the dispersion of the phosphor particles, it is effective to coat the surfaces of the phosphor particles with oxide or fluoride or to adhere such materials to the surfaces of the phosphor particles.

The following are examples of metal oxide that can be adhered to the surfaces of the phosphor particles or used to coat the phosphor particles: magnesium oxide (MgO); aluminum oxide ($Al_2O_3$); silicon oxide ($SiO_2$); indium oxide ($InO_3$); zinc oxide (ZnO); and yttrium oxide ($Y_2O_3$). Out of these, $SiO_2$is well known as an oxide that becomes negatively charged, while ZnO, $Al_2O_3$, and $Y_2O_3$ are well known as oxides that become positively charged. Applying these materials to the surfaces of the phosphor particles is especially effective.

The particle diameter of the oxide applied to the particles should be considerably lower than the particle diameter of the phosphor particles. The amount of oxide applied to the phosphor particles should also be around 0.05 to 2.0% by weight of the phosphor particles. If the amount is too low, the material will have little effect, while if the amount is too high, the material will absorb the UV-light rays that are produced in the plasma, lowering the overall panel luminance.

The following are examples of fluorides that may be applied to the surfaces of the phosphor particles: magnesium fluoride ($MgF_2$) and aluminum fluoride ($AlF_3$).

(2) Binder

Ethyl cellulose and polyethylene oxide (a polymer of ethylene oxide) are examples of binders that achieve favorable dispersion of the phosphor particles. In particular, ethylene cellulose containing 49 to 54% of the ethoxy group ($—OC_2H_5$) is preferable.

Photosensitive resin may also be used as the binder.

(3) Solvent

It is preferable to use a mixture of organic solvents including the hydroxide group (OH group) as the solvent. The following are specific examples: terpineol ($C_{10}H_{18}O$); butyl carbitol acetate; pentanediol (2,2,4-trimethyl pentandiol monoisobutylate); dipentene (otherwise known as "Limonene"); and butyl carbitol.

A mixed solvent including these organic solvents have superior ability to dissolve the binder given above, as well as achieving superior dispersion for phosphor ink.

The phosphor ink should contain around 35 to 60% of phosphors by weight, and around 0.15 to 10% of binder by weight.

Note that in order to control the form of the phosphor ink: that is applied to the channels, the amount of binder should be set relatively high within a range where the ink does not become excessively viscose.

(4) Dispersant

By adding a dispersant to a phosphor ink with the above composition, the phosphor particles can be more favorably dispersed within the ink.

As example dispersants, the following surface-active agents can be used.

Anionic Surface-Active Agents

Salts of fatty acids, alkyl sulfate, ester salts, alkyl benzene sulfonate, alkyl sulfosuccinic acid salt, naphthalene sulfonic acid polycarbonic acid polymer.

Nonionic Surface-Active Agents

Polyoxy ethylene alkyl ether, polyoxy ethylene derivatives, sorbiton fatty ester, glycerol fatty acid ester, and polyoxy ethylene alkyl amin.

Cationic Surface-Active Agents

As examples, alkyl amin salt, quarternary ammonium salt, alkyl betaine, and amin oxide.

(5) Charge-Removing Material

It is also preferable to add a charge-removing material to the phosphor ink.

The surface-active agents listed above in (4) as dispersants generally have a charge-removing effect that stops the phosphor ink from becoming electrically charged, so that many of these substances equate to charge-removing materials. The charge-removing effect differs depending on which phosphors, binder, and solvent are used, so that it is preferable for experiments to be conducted for a variety of different surface-active agents to enable an effective material to be selected.

An amount of surface-active agent in a range of 0.05 to 0.3% by weight is suitable. A smaller amount will not improve dispersion of the phosphors sufficiently and will not achieve a sufficient charge-removing effect. Too much surface-active agent will however affect the luminance of the display panel.

Apart from surface-active agents, fine particles of a conductive material can be used as the charge-removing material.

Specific examples of such are fine particles of carbon such as carbon black, fine particles of graphite, fine particles of a metal such as Al, Fe, Mg, Si, Cu, Sn, Ag, or fine particles of an oxide of these metals.

It is preferable to add 0.05 to 1.0% by weight of these conductive fine particles to the phosphor ink.

By adding a charge-removing material to the phosphor ink, electrical charging of the phosphor ink can be avoided, which has the following effect during the manufacturing of a PDP.

When a charge-removing material is not added to the phosphor ink, there is the problem of blurred lines appearing when the manufactured PDP is driven. The occurrence of such blurred lines is suppressed when a charge-removing material is added to the phosphor ink.

Also, when a charge-removing material is not added to the phosphor ink, the phosphor ink becomes charged, making it more likely that the phosphor layer in the gaps between the address electrodes 22 (see FIG. 2) in the center of the PDP will rise up. This can also be suppressed by adding a charge-removing material to the phosphor ink.

Phosphor ink (especially phosphor ink that contains organic solvents) becomes charged when it is applied, leading to fluctuations in the amount of phosphor ink applied to each channel and in the way in which the phosphor ink is applied. When a charge-removing material is added to the phosphor ink, it is believed that such charging can be avoided.

Also, suppressing the electrical charging of the phosphor ink helps prevent the mixing of colors due to the scattering of ink droplets.

When a surface-active agent or fine carbon particles are used as the charge-removing material, this charge-removing material evaporates or burns when the phosphors are baked to remove the solvent and binder in the phosphor ink. This means that no charge-removing material is left in the phosphor layer after baking. As a result, charge-removing material left in the phosphor layer does not affect the driving (illumination) of the PDP.

Manufacturing Process for the Phosphor Ink

The phosphor inks are formed by dissolving the 0.2 to 10% by weight of the binder described above in the solvent. This is then mixed with phosphor particles of the different colors, and the phosphor particles are dispersed using a disperser to form the phosphor inks of the different colors.

The following may be used as the disperser. A vibration mill or an agitating socket-type mill that disperses a material using a balls, (a ball mill, a bead mill, a sand mill etc.) may be used. Alternatively, a device that does not use balls, such as a flow pipe, or jet mill may be used.

Zirconia or alumina balls are used as the dispersing medium for a vibration mill or an agitating socket-type mill. In particular, zirconia ($ZrO_2$) balls with a diameter of 0.2 to 2 mm are preferable. Use of such balls limits the damage to the phosphor particles and the introduction of contaminants into the ink.

When a jet mill is used, dispersion should be preferably be performed with the pressure in the range of 10 to 100 $kgf/cm^2$. This range is preferable since pressures of below 10 $kgf/cm^2$ are incapable of sufficiently dispersing the phosphor ink, while pressures in excess of 100 $kgf/cm^2$ tend to crush the phosphor particles.

The viscosity of the phosphor ink should be 2000 centipoise or below at a temperature of 25° C. and a shear rate of 100 $sec^{-1}$, with the phosphor ink being preferably adjusted so that its viscosity is in the range of 10 to 500 centipoise.

The following describes one example of how an oxide or fluoride can be applied to the surfaces of the phosphor particles. A suspension of a metal oxide, such as magnesium oxide (MgO), aluminum oxide ($Al_2O_3$), silicon oxide ($SiO_2$), indium oxide ($In_2O_3$), or a suspension f a metal fluoride, such a magnesium fluoride ($MgF_2$), or aluminum fluoride ($AlF_3$), is added to a suspension containing the phosphor particles, and then the suspensions are mixed and agitated. After this, the mixture is subjected to suction filtration to remove the particles. The particles are dried using a temperature of at least 125° C. and then baked at a temperature of at least 350° C.

To increase the adhesion of the oxide or fluoride to the phosphor particles, a small amount of a resin, a silane coupler, or water glass may be added to the suspensions.

As another example, a coating of aluminum oxide ($Al_2O_3$) can be formed on the surfaces of the phosphor particles by adding the phosphor particles to an alcohol solution of $Al(OC_2H_5)_3$, which is an aluminum alkoxide, and then agitating the mixture.

Regarding the Effect of the Phosphor Ink of the Present Embodiment

As described above, the phosphor ink of the present embodiment is favorably dispersed so that when the phosphor ink is applied in the channels between the partition walls, the phosphor ink is favorably applied to the side faces of the partition walls. The reasons for this are as follows.

Figure 8:
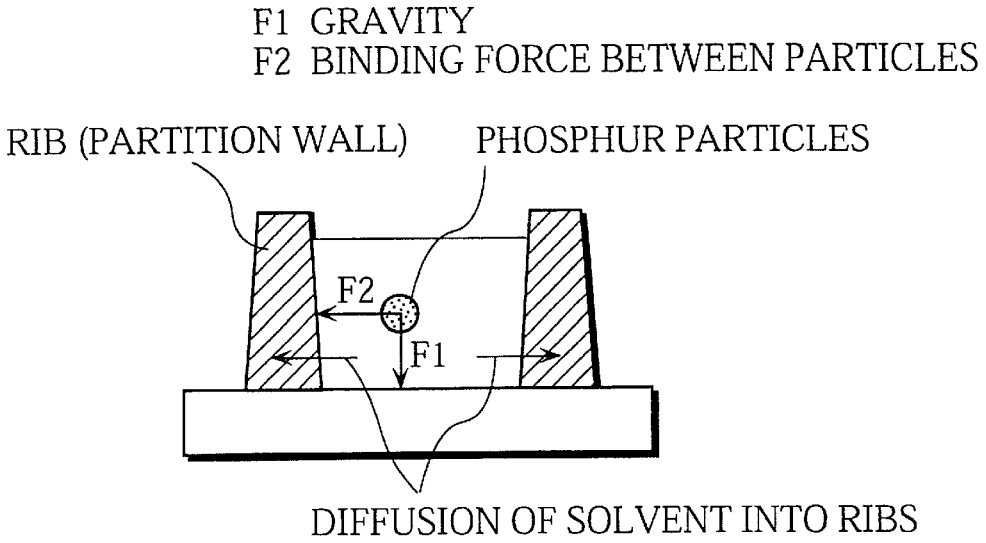
FIG. 8 is a representation of how the phosphor layer is formed when phosphor ink has been applied to a channel.

FIG. 8 is a representation of how the phosphor layer is formed after the phosphor ink has been applied to the channels between the partition walls.

When a highly fluid phosphor ink is used to fill the spaces between the partition walls, the phosphor particles in the phosphor ink will tend to settle due to the action of gravity F1.

At the same time, the phosphor particles in the phosphor ink are also subject to the force F2 that moves the phosphor particles toward the side faces of the partition walls. This force F2 is generated due to the solvent present in the phosphor ink seeping into the partition walls 30 and the phosphor particles being combined with the solvent by the binder. As a result, the phosphor particles also move toward the partition walls 30.

The form of the phosphor layer that is eventually formed in the channels between the partition walls is determined by the balance between the forces F1 and F2. The higher the fluidity of the phosphor ink, the stronger the force F2, so that phosphor ink can be favorably applied to the side faces of the partition walls.

It is also favorable to set the amount of binder in the phosphor ink at the upper end of the allowed range for the same reason. Since an increase in the amount of binder increases the force F2, improvements can be made to the amount of phosphor ink that is applied to the side faces of the partition walls.

Improvements in the amount of phosphor ink that is applied to the side faces of the partition walls increase the proportion of the phosphor layer that is formed on these side faces, which in turn improves the luminance of the resulting PDP. This is because the UV light generated at positions close to the display electrodes can be efficiently converted into visible light.

Figure 9:
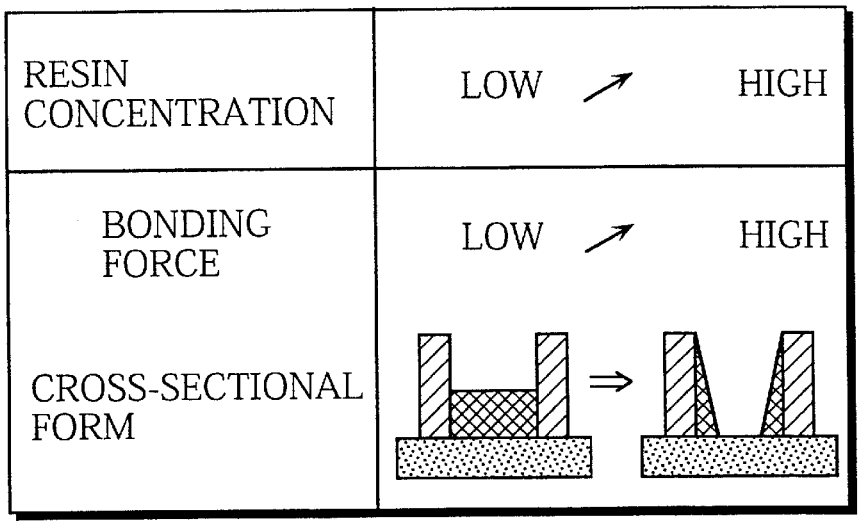
FIG. 9 shows the relationship between the concentration of the binder in the phosphor ink and the form in which a phosphor layer is formed.

FIG. 9 is a representation of how the form of the phosphor layer changes depending on the concentration of resin binder in the phosphor ink.

As shown in FIG. 9, when the concentration of the resin is low, most of the phosphor particles settle in the bottom of the channel, so that a phosphor layer is only formed in the bottom of the channel. However, as the concentration of resin is increased, the binding of the binder to the phosphor particles is improved, so that the amount of phosphor applied to the side faces of the partition walls increases. Once the concentration of resin reaches a certain level, a phosphor layer will only be formed on the side walls of the partition walls.

Note that when phosphor inks of different colors are applied in order, the phosphor ink of the second and third colors will be applied with ink already present in the adjacent channels. This means that solvent will have already seeped into a side face of one or both of the partition walls of a channel into which phosphor ink is being applied. As a result, it will be difficult for the solvent in the phosphor ink being applied now to seep into such partition walls, and if dispersion of the phosphor ink is poor, the force F2 will have almost no effect.

However, if well-dispersed phosphor ink is used as in the present embodiment, the force F2 will still have some effect, even when phosphor ink has already been applied to the adjacent channels. This means that phosphor ink can be favorably applied to the side faces of the partition walls.

Figure 10:
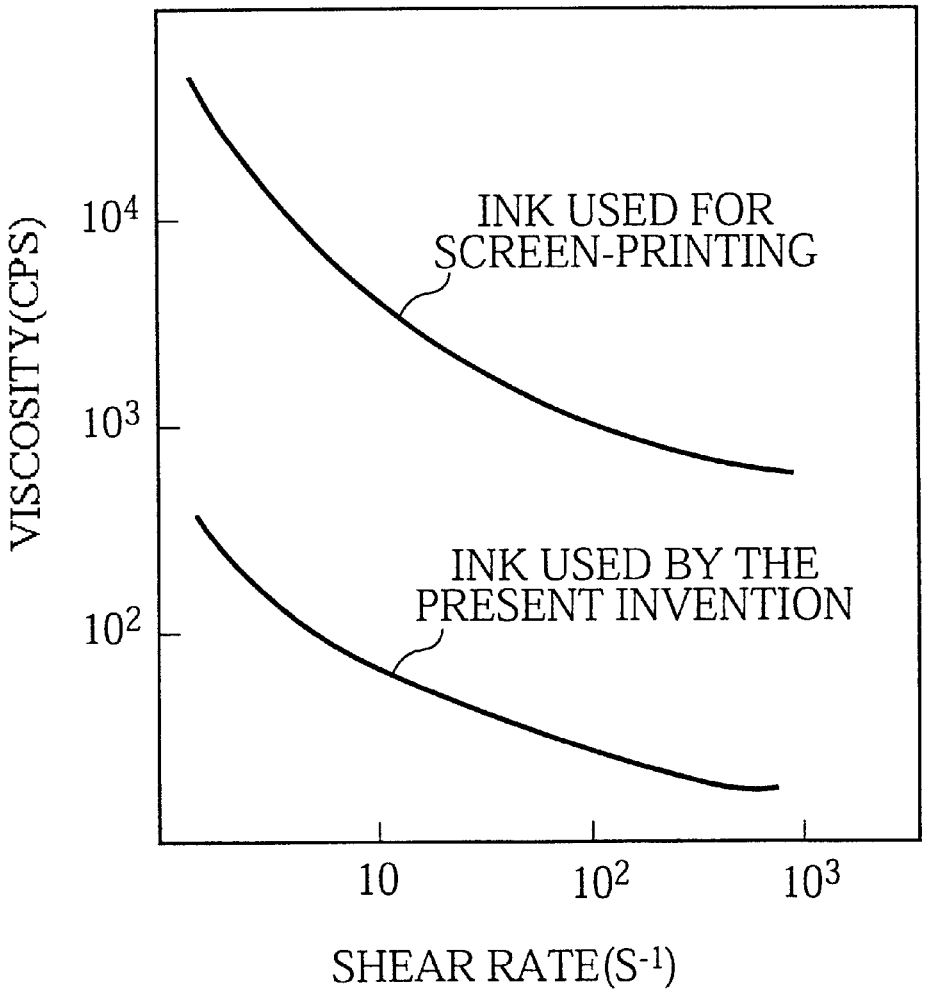
FIG. 10 is a graph that compares the viscosity of the phosphor ink of the present invention with the viscosity of the phosphor ink used in a screen-printing method.

Note that the diameter of the opening in the nozzle 54 is normally set much smaller than the pitch of the partition walls. In order to expel phosphor ink consistently from a fine nozzle, the viscosity of the ink needs to be low. As shown in FIG. 10, the viscosity of the ink needs to be around two decimal places lower that the viscosity of the ink used in conventional screen printing.

While blockages normally occur for a nozzle for the reasons given above, the phosphor particles are well dispersed in the phosphor ink of the present embodiment, so that blockages are avoided and phosphor ink can be continuously applied for a long time, such as over 100 hours.

The opening of the nozzle 54 should be set considerably smaller than the pitch of the partition walls for the following reasons.

FIG. 11 shows how the phosphor ink is expelled from the nozzle.

Figure 11A:
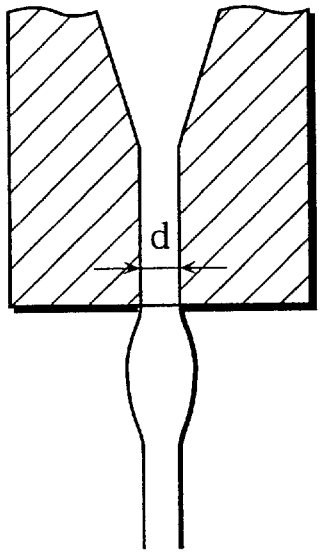
FIG. 11 shows the state in which the phosphor ink emerges from the nozzle.

As shown in FIG. 11A, the phosphor ink tends to expand once it is expelled from the nozzle. This is otherwise know as the "Barus effect" and due to this effect, the nozzle diameter d needs to be set considerably smaller than the pitch of the partition walls. When the PDP is of VGA class with a partition pitch of 360 $\mu$m, the nozzle diameter d needs to be set around 100 $\mu$m. Meanwhile, when the PDP is of HD class, the nozzle diameter d needs to be set at around 50 $\mu$m, an extremely small distance.

Modification to the Method for Applying the Phosphor Ink

Figure 11B:
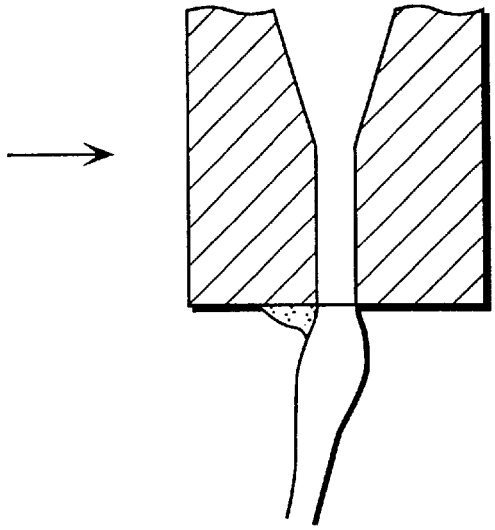

When the expulsion of a phosphor ink with low viscosity from the nozzle is stopped, the ink jet that emerges thereafter is likely to veer away from the central axis as shown in FIG. 11B, making the flow of ink unstable.

The reason for this is that when the expulsion of the ink stops, the phosphor ink sticks to the edge (the lower surface) of the opening in the end of the nozzle. This part becomes wetter than other parts, especially when the opening in the nozzle is narrow and the ink viscosity is low.

To stop this from happening, ink may be continuously expelled from the nozzle 54, even during the periods when the nozzle 54 is moving between channels into which phosphor ink is being successively applied.

In more detail, if ink is continuously expelled from the nozzle 54 even when the nozzle 54 has moved to a position beyond the channels, phosphor ink can be kept from sticking to the lower surface of the end of the nozzle 54, thereby avoiding situations where the ink jet bends as shown in FIG. 11B.

As one example, phosphor ink may be continuously expelled from the nozzle 54 until the application of one color of phosphor ink has been completed for the entire back glass substrate 21. During this period, the ink jet will not veer away from the central axis, meaning that ink can be applied properly.

First Set of Tests

Several PDP were manufactured in accordance with the method described in the embodiment given above. Inks produced with different phosphor particles, resins, and types/amounts of solvent were applied to different PDP.

TABLE 1

| REFERENCE NUMBER | TYPE AND PARTICLE DIAMETER OF PHOSPHURS, CONTAINED AMOUNT OF PHOSPHURS | | | TYPE AND PROPERTIES OF RESIN, CONTAINED AMOUNT OF RESIN | MIXED SOLVENT AND CONTAINED AMOUNT |
|---|---|---|---|---|---|
| | | | | ETHYL CELLULOSE CONTAINING 48% OF ETHOXY GROUP | TERPINEOL-DIPENTENE |
| 1 | (B) BaMgAl10O17:Eu | 3.0 $\mu$m | 50 wt. % | (B) 0.15 wt. % | (B) 49.8 wt. % |
| | (R) (YGd)BO3:Eu | 3.0 $\mu$m | 60 wt. % | (R) 0.2 wt. % | (R) 39.7 wt. % |
| | (G) Zn2SiO4:Mn | 3.0 $\mu$m | 55 wt. % | (G) 0.45 wt. % | (G) 44.5 wt. % |

TABLE 1-continued

| | | | | | |
|---|---|---|---|---|---|
| | | | | ETHYL CELLULOSE CONTAINING 50% OF ETHOXY GROUP | TERPINEOL-LIMONENE |
| 2 | (B) BaMgAl10O17:Eu<br>(R) (YGd)BO3:Eu<br>(G) Zn2SiO4:Mn | 2.5 μm<br>2.5 μm<br>2.5 μm | 45 wt. %<br>55 wt. %<br>50 wt. % | (B) 0.3 wt. %<br>(R) 0.3 wt. %<br>(G) 0.5 wt. % | (B) 54.6 wt. %<br>(R) 44.55 wt. %<br>(G) 49.4 wt. % |
| | | | | ETHYL CELLULOSE CONTAINING 54% OF ETHOXY GROUP | TERPINEOL-BUTYL CARBITOL |
| 3 | (B) BaMgAl10O17:Eu<br>(R) Y2O3:Eu<br>(G) Zn2SiO4:Mn | 0.5 μm<br>0.5 μm<br>0.5 μm | 35 wt. %<br>35 wt. %<br>40 wt. % | (B) 0.15 wt. %<br>(R) 0.2 wt. %<br>(G) 0.3 wt. % | (B) 64.65 wt. %<br>(R) 64.5 wt. %<br>(G) 59.5 wt. % |

| REFERENCE NUMBER | TYPE OF DISPERSANT AND CONTAINED AMOUNT | VISCOSITY OF INK (CENTIPOISE) | VISCOSITY OF INK (CENTIPOISE) | MIXING OF COLORS | PANEL LUMINANCE (cd/m$^2$) |
|---|---|---|---|---|---|
| | POLYOXYETHYLENE ALKYLAMINE | | | | |
| 1 | (B) 0.05 wt. %<br>(R) 0.1 wt. %<br>(G) 0.05 wt. % | 30 | APPLIED ALL THE WAY UP THE SIDE FACES | NONE | 530 |
| | POLYCARBON ACID HIGH POLYMER | | | | |
| 2 | (B) 0.1 wt. %<br>(R) 0.15 wt. %<br>(G) 0.1 wt. % | 20 | APPLIED ALL THE WAY UP THE SIDE FACES | NONE | 545 |
| | POLYOXYETHYLENE ALKYL ESTER | | | | |
| 3 | (B) 0.2 wt. %<br>(R) 0.3 wt. %<br>(G) 0.2 wt. % | 500 | APPLIED ALL THE WAY UP THE SIDE FACES | NONE | 552 |

TABLE 2

| REFERENCE NUMBER | TYPE AND PARTICLE DIAMETER OF PHOSPHURS, CONTAINED AMOUNT OF PHOSPHURS | | | TYPE AND PROPERTIES OF RESIN, CONTAINED AMOUNT OF RESIN | MIXED SOLVENT AND CONTAINED AMOUNT |
|---|---|---|---|---|---|
| | | | | ETHYL CELLULOSE CONTAINING 48% OF ETHOXY GROUP | BUTYL CARBITOL-PENTANDIOL |
| 4 | (B) BaMgAl10O17:Eu<br>(R) (YGd)BO3:Eu<br>(G) Zn2SiO4:Mn | 2.0 μm<br>2.0 μm<br>2.0 μm | 50 wt. %<br>50 wt. %<br>45 wt. % | (B) 0.5 wt. %<br>(R) 0.4 wt. %<br>(G) 0.6 wt. % | (B) 54.35 wt. %<br>(R) 49.45 wt. %<br>(G) 54.3 wt. % |
| | | | | ETHYL CELLULOSE CONTAINING 50% OF ETHOXY GROUP | BUTYL CARBITOL-LIMONENE |
| 5 | (B) BaMgAl10O17:Eu<br>(R) (YGd)BO3:Eu<br>(G) Zn2SiO4:Mn | 5.0 μm<br>5.0 μm<br>5.0 μm | 60 wt. %<br>60 wt. %<br>60 wt. % | (B) 1.0 wt. %<br>(R) 0.8 wt. %<br>(G) 1.5 wt. % | (B) 38.7 wt. %<br>(R) 33.85 wt. %<br>(G) 38.2 wt. % |
| | | | | ETHYL CELLULOSE CONTAINING 54% OF ETHOXY GROUP | BUTYL CARBITOL-LIMONENE |
| 6 | (B) BaMgAl10O17:Eu<br>(R) Y2O3:Eu<br>(G) Zn2SiO4:Mn | 0.5 μm<br>0.5 μm<br>0.5 μm | 40 wt. %<br>35 wt. %<br>40 wt. % | (B) 0.3 wt. %<br>(R) 0.35 wt. %<br>(G) 0.45 wt. % | (B) 59.5 wt. %<br>(R) 64.45 wt. %<br>(G) 59.35 wt. % |

TABLE 2-continued

| REFERENCE NUMBER | TYPE OF DISPERSANT AND CONTAINED AMOUNT | VISCOSITY OF INK (CENTIPOISE) | VISCOSITY OF INK (CENTIPOISE) | MIXING OF COLORS | PANEL LUMINANCE (cd/m$^2$) |
|---|---|---|---|---|---|
| | POLYOXYETHYLENE ALKYLAMINE | | | | |
| 4 | (B) 0.15 wt. %<br>(R) 0.15 wt. %<br>(G) 0.1 wt. % | 25 | APPLIED ALL THE WAY UP THE SIDE FACES | NONE | 540 |
| | POLYOXYETHYLENE OLEYL ESTER | | | | |
| 5 | (B) 0.1 wt. %<br>(R) 0.35 wt. %<br>(G) 0.1 wt. % | 15 | APPLIED ALL THE WAY UP THE SIDE FACES | NONE | 550 |
| | SORBITAN MONOOLEATE | | | | |
| 6 | (B) 0.2 wt. %<br>(R) 0.2 wt. %<br>(G) 0.2 wt. % | 85 | APPLIED ALL THE WAY UP THE SIDE FACES | NONE | 557 |

TABLE 3

| REFERENCE NUMBER | TYPE AND PARTICLE DIAMETER OF PHOSPHURS, CONTAINED AMOUNT OF PHOSPHURS | | | TYPE AND PROPERTIES OF RESIN, CONTAINED AMOUNT OF RESIN | MIXED SOLVENT AND CONTAINED AMOUNT |
|---|---|---|---|---|---|
| | | | | POLYETHYLENE OXIDE | MIXTURE OF TERPINEOL AND METHANOL |
| 7 | (B) BaMgAl10O17:Eu<br>(R) (YGd)BO3:Eu<br>(G) Zn2SiO4:Mn | 3.0 μm<br>3.0 μm<br>3.0 μm | 50 wt. %<br>60 wt. %<br>55 wt. % | (B) 1.5 wt. %<br>(R) 1.4 wt. %<br>(G) 1.2 wt. % | (B) 48.4 wt. %<br>(R) 38.5 wt. %<br>(G) 43.7 wt. % |
| | | | | POLYETHYLENE OXIDE | MIXTURE OF TERPINEOL AND METHANOL |
| 8 | (B) BaMgAl10O17:Eu<br>(R) (YGd)BO3:Eu<br>(G) Zn2SiO4:Mn | 2.0 μm<br>2.0 μm<br>2.0 μm | 45 wt. %<br>55 wt. %<br>50 wt. % | (B) 1.0 wt. %<br>(R) 0.9 wt. %<br>(G) 0.8 wt. % | (B) 53.85 wt. %<br>(R) 43.95 wt. %<br>(G) 49.05 wt. % |
| | | | | POLYETHYLENE OXIDE | MIXTURE OF TERPINEOL AND METHANOL |
| 9 | (B) BaMgAl10O17:Eu<br>(R) Y2O3:Eu<br>(G) Zn2SiO4:Mn | 1.5 μm<br>1.5 μm<br>1.5 μm | 40 wt. %<br>50 wt. %<br>45 wt. % | (B) 0.7 wt. %<br>(R) 0.6 wt. %<br>(G) 0.5 wt. % | (B) 59.1 wt. %<br>(R) 49.1 wt. %<br>(G) 54.2 wt. % |

| REFERENCE NUMBER | TYPE OF DISPERSANT AND CONTAINED AMOUNT | VISCOSITY OF INK (CENTIPOISE) | VISCOSITY OF INK (CENTIPOISE) | MIXING OF COLORS | PANEL LUMINANCE (cd/m$^2$) |
|---|---|---|---|---|---|
| | POLYOXYETHYLENE ALKYLAMINE | | | | |
| 7 | (B) 0.1 wt. %<br>(R) 0.1 wt. %<br>(G) 0.1 wt. % | 100 | APPLIED ALL THE WAY UP THE SIDE FACES | NONE | 538 |
| | HIGH POLYMER UNSATURATED CARBOXYLIC ACID | | | | |
| 8 | (B) 0.1 wt. %<br>(R) 0.15 wt. %<br>(G) 0.15 wt. % | 150 | APPLIED ALL THE WAY UP THE SIDE FACES | NONE | 545 |

TABLE 3-continued

| | | | | | |
|---|---|---|---|---|---|
| | HIGH POLYMER CARBOXYLIC ACID | | | | |
| 9 | (B) 0.2 wt. %<br>(R) 0.3 wt. %<br>(G) 0.3 wt. % | 400 | APPLIED ALL THE WAY UP THE SIDE FACES | NONE | 550 |

TABLE 4

| REFERENCE NUMBER | TYPE AND PARTICLE DIAMETER OF PHOSPHURS, CONTAINED AMOUNT OF PHOSPHURS | | | TYPE AND PROPERTIES OF RESIN, CONTAINED AMOUNT OF RESIN | MIXED SOLVENT AND CONTAINED AMOUNT |
|---|---|---|---|---|---|
| | | | | ACRYLIC RESIN | TERPINEOL |
| 10* | (B) BaMgAl10O17:Eu<br>(R) (YGd)BO3:Eu<br>(G) Zn2SiO4:Mn | 3.0 μm<br>3.0 μm<br>3.0 μm | 50 wt. %<br>50 wt. %<br>50 wt. % | (B) 13.95 wt. %<br>(R) 13.95 wt. %<br>(G) 13.95 wt. % | (B) 36 wt. %<br>(R) 36 wt. %<br>(G) 36 wt. % |
| | | | | ETHYL CELLULOSE CONTAINING 50% OF ETHOXY GROUP | TERPINEOL |
| 11* | (B) BaMgAl10O17:Eu<br>(R) (YGd)BO3:Eu<br>(G) Zn2SiO4:Mn | 2.5 μm<br>2.5 μm<br>2.5 μm | 45 wt. %<br>55 wt. %<br>50 wt. % | (B) 0.3 wt. %<br>(R) 0.3 wt. %<br>(G) 0.5 wt. % | (B) 54.7 wt. %<br>(R) 44.7 wt. %<br>(G) 49.5 wt. % |
| | | | | POLYVINYL ALCOHOL | WATER |
| 12* | (B) BaMgAl10O17:Eu<br>(R) Y2O3:Eu<br>(G) Zn2SiO4:Mn | 0.5 μm<br>0.5 μm<br>0.5 μm | 60 wt. %<br>60 wt. %<br>60 wt. % | (B) 4.0 wt. %<br>(R) 4.0 wt. %<br>(G) 4.0 wt. % | (B) 36 wt. %<br>(R) 36 wt. %<br>(G) 36 wt. % |

| REFERENCE NUMBER | TYPE OF DISPERSANT AND CONTAINED AMOUNT | VISCOSITY OF INK (CENTIPOISE) | VISCOSITY OF INK (CENTIPOISE) | MIXING OF COLORS | PANEL LUMINANCE (cd/m$^2$) |
|---|---|---|---|---|---|
| | GLYCERIN TRIOLEATE | | | | |
| 10* | (B) 0.05 wt. %<br>(R) 0.1 wt. %<br>(G) 0.05 wt. % | 25 | APPLIED ALL THE WAY UP THE SIDE FACES | NONE | 480 |
| 11* | NONE | 45 | APPLIED ALL THE WAY UP THE SIDE FACES | NONE | 475 |
| 12* | NONE | 100 | APPLIED ALL THE WAY UP THE SIDE FACES | NONE | 460 |

Examples 1 to 9 in Tables 1 to 3 relate to the above embodiment. The phosphor inks used were manufactured by dispersing phosphor particles using a sand mill including zirconia balls of 0.2 mm to 2 mm in size.

Tables 1 to 3 show the particle diameter, type and amount of resin, type and amount of solvent, type and amount of dispersing medium, and the viscosity of the phosphor ink during application (viscosity where the shear rate is 100 $sec^{-1}$ at 25° C.).

When manufacturing a PDP of the above embodiment, the pitch of the partition walls 30 was set at 0.15 mm and the height of the partition walls 30 at 0.15 mm.

The phosphor layer was formed by applying phosphor inks of different colors to the channels as far as the upper parts of the partition walls 30 and then baking at 500° C. for 10 minutes. Neon gas including 10% xenon gas was introduced as the discharge gas and the PDPs were sealed with an internal pressure of 500 Torr.

Examples 10 to 12 in Table 4 are comparative examples. In Example 10, acrylic resin and a dispersant (glyceryl trioleate) were combined when making the phosphor ink. In Example 11, 50% ethyl cellulose including ethoxy group and terpineol were combined, but no dispersant was added. In Example 12, polyvinyl alcohol and water were combined, but no dispersant was added. The PDPs of these comparative examples were otherwise identical to the PDPs of Examples 1 to 9 that correspond to the embodiments.

Comparison Tests

The extent to which ink was applied to the partition walls, the presence of blurring (i.e. the mixing of colors), and panel luminance were examined for the example PDPs mentioned above.

The presence of blurring was measured by illuminating each colored ink on a PDP separately and then measuring the amount of emitted light.

As a result, it was found that phosphor ink was applied as far as the tops of the partition walls 30 in every PDP of the embodiments and the comparative examples. Blurring of colors was exhibited by none of the PDPs.

Panel luminance was measured using a luminance meter with the PDPs being driven using a discharge sustaining voltage (frequency 30 Hz) of 150V. The results are shown in Tables 1 to 4.

The wavelength of the ultra-violet light emitted when these PDPs were driven was found to be roughly equal to the excitation wavelength of a xenon molecular beam that is centered on 173 nm.

Experiments were also conducted where the manufactured phosphor inks were continuously expelled from the nozzle. Each phosphor ink manufactured in accordance with the above embodiment could be expelled continuously for 100 hours, while blockages of the nozzle occurred within 8 hours when the phosphor inks of the comparative example were used.

Remarks

As shown in Tables 1–4, Examples 1–9 that correspond to the embodiments all exhibited a panel luminance of 530 cd/m$^2$ or above, which exceeds the panel luminance (460 to 480 cd/m$^2$) exhibited by the Comparative Examples 10 to 12. This is believed to be due to the proportion of the phosphor layer on the sides of the partition walls relative to the amount on the base of the channels being higher in the PDPs of the present embodiment than in the PDPs of the comparative examples.

Second Set of Tests

In the examples 21 and 22, the following phosphors were used: red (Y,Gd)$BO_3$:Eu; blue $BaMgAl_{10}O_{17}$:Eu; green $ZnSiO_4$:Mn. In the phosphor inks of each color, an oxide ($SiO_2$) that becomes negatively charged was applied (as a coating) to the surface of the phosphor particles.

Silicon oxide ($SiO_2$) was applied to the surfaces of the phosphor particles by first manufacturing suspensions of the phosphors of each color and a suspension of SiO2 particles (the $SiO_2$ particles having a particle diameter that is 1/10 or less of the diameter of the phosphor particles). A phosphor particle suspension was then mixed with the $SiO_2$ suspension and the mixture was agitated. After this, the mixture was subjected to suction filtration to remove the particles, the particles were dried using a temperature of at least 125° C. and then baked at a temperature of at least 350° C.

The phosphor particles that were coated with $SiO_2$ particles were then combined with a resinous material made of ethyl cellulose, and a mixed solvent of terpineol and pentandiol (1/1) in the proportions shown in Table 5. A jet mill was used to mix and disperse the particles, thereby producing the phosphor inks. During dispersion, a pressure range of 10 to 200 Kgf/cm$^2$ was used.

The phosphor inks produced in this way were adjusted to make their viscosity equal to the values shown in Table 5 before application. Other aspects of the PDPs were the same as those described in the first set of tests.

As in the first set of tests, the extent to which ink was applied to the partition walls, the presence of blurring, and panel luminance were examined for example PDPs. As a result, phosphor ink was found to be applied all the way up the side walls of each PDP. None of the PDPs suffered from blurring.

As shown in Table 5, each PDP exhibited favorable panel luminance.

No blockage of the nozzle occurred when the inks used in Examples 21 and 22 were expelled continuously for over 100 hours.

Third Set of Tests

TABLE 5

| REFERENCE NUMBER | MATERIAL APPLIED TO PHOSPHURS (wt %), TYPE AND PARTICLE DIAMETER OF PHOSPHORS, CONTAINED AMOUNT OF PHOSPHURS | | | TYPE AND PROPERTIES OF RESIN, CONTAINED AMOUNT OF RESIN | SOLVENT AND CONTAINED AMOUNT |
|---|---|---|---|---|---|
| | 0.1% COATING OF SiO2 (PARTICLE DIAMETER 0.2 μm) RELATIVE TO WEIGHT OF PHOSPHURS | | | ETHYL CELLULOSE CONTAINING 50% OF ETHOXY GROUP | TERPINEOL AND PENTANDIOL |
| 21 | (B) BaMgAl10O17:Eu | 3.0 μm | 50 wt. % | (B) 0.5 wt. % | (B) 49.5 wt. % |
| | (R) (YGd)BO3:Eu | 3.0 μm | 50 wt. % | (R) 0.2 wt. % | (R) 49.8 wt. % |
| | (G) Zn2SiO4:Mn | 3.0 μm | 50 wt. % | (G) 2.0 wt. % | (G) 48.0 wt. % |
| | 0.05% COATING OF SiO2 (PARTICLE DIAMETER 0.05 μm) RELATIVE TO WEIGHT OF PHOSPHURS | | | ETHYL CELLULOSE CONTAINING 50% OF ETHOXY GROUP | TERPINEOL AND PENTANDIOL |
| 22 | (B) BaMgAl10O17:Eu | 3.0 μm | 50 wt. % | (B) 0.5 wt. % | (B) 49.5 wt. % |
| | (R) (YGd)BO3:Eu | 3.0 μm | 50 wt. % | (R) 0.2 wt. % | (R) 49.8 wt. % |
| | (G) Zn2SiO4:Mn | 3.0 μm | 50 wt. % | (G) 2.0 wt. % | (G) 48.0 wt. % |

| REFERENCE NUMBER | PERIOD FOR WHICH INK CAN BE CONTINUOUSLY EXPELLED FROM NOZZLE | VISCOSITY OF INK (100S-1) (CENTIPOISE) | APPLIED STATE OF PHOSPHURS ON SIDE FACES | PANEL LUMINANCE |
|---|---|---|---|---|
| 21 | 100 HRS CONTINUOUS OPERATION POSSIBLE | 70 | APPLIED ALL THE WAY UP THE SIDE FACES | 558 |
| 22 | 100 HRS CONTINUOUS OPERATION POSSIBLE | 150 | APPLIED ALL THE WAY UP THE SIDE FACES | 550 |

This third set of tests included example PDPs (31 to 37) where various surface-active agents were added to the phosphor ink as dispersants and/or charge-removing materials and example PDPs (38 to 42) where fine conductive particles were added to the phosphor ink as charge-removing materials.

Of these PDPs, Examples 31 to 34 are PDPs where ZnO and MgO were applied to the surfaces of the phosphors in the phosphor inks.

Note that Example PDP 43 was produced without adding charge-removing material to the phosphor inks.

TABLE 6

| REFERENCE NUMBER | TYPE AND PARTICLE DIAMETER OF PHOSPHORS, AMOUNT OF PHOSPHORS CONTAINED IN INK | MATERIAL APPLIED TO PHOSPHURS | TYPE AND PROPERTIES OF RESIN | AMOUNT OF SOLVENT IN INK | TYPE OF SOLVENT | AMOUNT OF SOLVENT IN INK |
|---|---|---|---|---|---|---|
| 31 | BLUE: BaMgAl10O17: EU 3.0 μm 50 wt. % RED: (YGd) BO3: EU 3.0 μm 60 wt. % GREEN: Zn2SiO4: Mn 2.5 μm 50 wt. % | 0.3% MgO (PARTICLE DIAMETER 0.2 μm) RELATIVE TO WEIGHT OF PHOSPHURS | ETHYL CELLULOSE CONTAINING 49% OF ETHOXY GROUP | (B): 0.3 wt. % (R): 0.2 wt. % (G): 1.5 wt. % | TERPINEOL AND BUTYLCARBITOL ACETATE (l/l) | (B): 49.0 wt. % (R): 39.0 wt. % (G): 48.0 wt. % |
| 32 | BLUE: BaMgAl10O17: EU 2.5 μm 45 wt. % RED: (YGd) BO3: EU 2.5 μm 55 wt. % GREEN: Zn2SiO4: Mn 2.5 μm 50 wt. % | 0.1% MgO (PARTICLE DIAMETER 0.05 μm) RELATIVE TO WEIGHT OF PHOSPHURS | ETHYL CELLULOSE CONTAINING 50% OF ETHOXY GROUP | (B): 0.4 wt. % (R): 0.3 wt. % (G): 1.5 wt. % | TERPINEOL AND PENTANDIOL (l/l) | (B): 54.0 wt. % (R): 44.7 wt. % (G): 48.0 wt. % |
| 33 | BLUE: BaMgAl10O17: EU 0.5 μm 35 wt. % RED: (YGd) BO3: EU 2.5 μm 55 wt. % GREEN: Zn2SiO4: Mn 2.5 μm 50 wt. % | 1.0% MgO (PARTICLE DIAMETER 0.05 μm) RELATIVE TO WEIGHT OF PHOSPHURS | ETHYL CELLULOSE CONTAINING 54% OF ETHOXY GROUP | (B): 0.15 wt. % (R): 0.2 wt. % (G): 0.3 wt. % | TERPINEOL AND BUTYLCARBITOL ACETATE (l/l) | (B): 64.8 wt. % (R): 64.0 wt. % (G): 59.0 wt. % |
| 34 | BLUE: BaMgAl10O17: EU 2.0 μm 50 wt. % RED: (YGd) BO3: EU 2.0 μm 50 wt. % GREEN: Zn2SiO4: Mn 2.0 μm 45 wt. % | 0.3% ZnO (PARTICLE DIAMETER 0.2 μm) RELATIVE TO WEIGHT OF PHOSPHURS | ETHYL CELLULOSE CONTAINING 50% OF ETHOXY GROUP | (B): 0.5 wt. % (R): 0.4 wt. % (G): 0.5 wt. % | BUTYLCARBITOL ACETATE AND PENTANDIOL (l/l) | (B): 49.0 wt. % (R): 49.0 wt. % (G): 54.0 wt. % |
| 35 | BLUE: BaMgAl10O17: EU 3.0 μm 50 wt. % RED: (YGd) BO3: EU 3.0 μm 60 wt. % GREEN: Zn2SiO4: Mn 3.0 μm 50 wt. % | NONE | ETHYL CELLULOSE CONTAINING 49% OF ETHOXY GROUP | (B): 0.5 wt. % (R): 0.5 wt. % (G): 1.0 wt. % | TERPINEOL AND BUTYLCARBITOL ACETATE (l/l) | (B): 49.5 wt. % (R): 39.5 wt. % (G): 45.5 wt. % |

TABLE 6-continued

| REFERENCE NUMBER | TYPE AND PARTICLE DIAMETER OF PHOSPHORS, AMOUNT OF PHOSPHORS CONTAINED IN INK | MATERIAL APPLIED TO PHOSPHURS | TYPE AND PROPERTIES OF RESIN | AMOUNT OF SOLVENT IN INK | TYPE OF SOLVENT | AMOUNT OF SOLVENT IN INK |
|---|---|---|---|---|---|---|
| 36 | BLUE: BaMgAl10O17: EU 2.5 μm 50 wt. % RED: (YGd) BO3: EU 3.0 μm 55 wt. % GREEN: Zn2SiO4: Mn 2.5 μm 50 wt. % | NONE | ETHYL CELLULOSE CONTAINING 50% OF ETHOXY GROUP | (B): 0.4 wt. % (R): 0.3 wt. % (G): 0.5 wt. % | TERPINEOL AND PENTANDIOL (1/1) | (B): 49.0 wt. % (R): 44.3 wt. % (G): 49.0 wt. % |
| 37 | BLUE: BaMgAl10O17: EU 2.0 μm 50 wt. % RED: (YGd) BO3: EU 2.0 μm 50 wt. % GREEN: Zn2SiO4: Mn 2.0 μm 52 wt. % | NONE | ETHYL CELLULOSE CONTAINING 54% OF ETHOXY GROUP | (B): 0.5 wt. % (R): 0.5 wt. % (G): 0.5 wt. % | TERPINEOL AND BUTYLCARBITOL ACETATE (1/1) | (B): 49.0 wt. % (R): 44.0 wt. % (G): 47.0 wt. % |

TABLE 7

| REFERENCE NUMBER | TYPE AND PARTICLE DIAMETER OF PHOSPHORS, AMOUNT OF PHOSPHORS CONTAINED IN INK | MATERIAL APPLIED TO PHOSPHURS | TYPE AND PROPERTIES OF RESIN | AMOUNT OF SOLVENT IN INK | TYPE OF SOLVENT | AMOUNT OF SOLVENT IN INK |
|---|---|---|---|---|---|---|
| 38 | BLUE: BaMgAl10O17: EU 2.0 μm 50 wt. % RED: (YGd) BO3: EU 2.0 μm 50 wt. % GREEN: Zn2SiO4: Mn 2.0 μm 45 wt. % | NONE | ETHYL CELLULOSE CONTAINING 50% OF ETHOXY GROUP | (B): 0.5 wt. % (R): 0.4 wt. % (G): 0.6 wt. % | BUTYL CARBITOL ACETATE AND PENTANDIOL (1/1) | (B): 48.5 wt. % (R): 48.6 wt. % (G): 53.4 wt. % |
| 39 | BLUE: BaMgAl10O17: EU 3.0 μm 50 wt. % RED: (YGd) BO3: EU 3.0 μm 60 wt. % GREEN: Zn2SiO4: Mn 3.0 μm 53 wt. % | NONE | ETHYL CELLULOSE CONTAINING 49% OF ETHOXY GROUP | (B): 0.5 wt. % (R): 0.5 wt. % (G): 0.5 wt. % | TERPINEOL AND BUTYL CARBITOL ACETATE (1/1) | (B): 48.5 wt. % (R): 38.5 wt. % (G): 45.5 wt. % |
| 40 | BLUE: BaMgAl10O17: EU 2.5 μm 55 wt. % RED: (YGd) BO3: EU 2.0 μm 55 wt. % GREEN: Zn2SiO4: Mn 2.0 μm 50 wt. % | NONE | ETHYL CELLULOSE CONTAINING 50% OF ETHOXY GROUP | (B): 0.5 wt. % (R): 0.5 wt. % (G): 0.5 wt. % | TERPINEOL AND PENTANDIOL (1/1) | (B): 49.4 wt. % (R): 49.4 wt. % (G): 49.4 wt. % |

TABLE 7-continued

| REFERENCE NUMBER | TYPE AND PARTICLE DIAMETER OF PHOSPHORS, AMOUNT OF PHOSPHORS CONTAINED IN INK | MATERIAL APPLIED TO PHOSPHURS | TYPE AND PROPERTIES OF RESIN | AMOUNT OF SOLVENT IN INK | TYPE OF SOLVENT | AMOUNT OF SOLVENT IN INK |
|---|---|---|---|---|---|---|
| 41 | BLUE: BaMgAl10O17: EU 2.0 μm 50 wt. % RED: (YGd) BO3: EU 2.0 μm 55 wt. % GREEN: Zn2SiO4: Mn 2.0 μm 50 wt. % | NONE | ETHYLENE OXIDE POLYMER | (B): 0.5 wt. % (R): 0.5 wt. % (G): 0.5 wt. % | TERPINEOL AND BUTYL CARBITOL ACETATE (l/l) | (B): 49.4 wt. % (R): 49.4 wt. % (G): 49.4 wt. % |
| 42 | BLUE: BaMgAl10O17: EU 2.0 μm 50 wt. % RED: (YGd) BO3: EU 2.0 μm 50 wt. % GREEN: Zn2SiO4: Mn 2.0 μm 45 wt. % | NONE | ETHYL CELLULOSE CONTAINING 50% OF ETHOXY GROUP | (B): 0.5 wt. % (R): 0.5 wt. % (G): 0.5 wt. % | BUTYL CARBITOL ACETATE AND PENTANDIOL (l/l) | (B): 49.4 wt. % (R): 49.4 wt. % (G): 54.4 wt. % |
| 43 | BLUE: BaMgAl10O17: EU 3.0 μm 50 wt. % RED: (YGd) BO3: EU 3.0 μm 60 wt. % GREEN: Zn2SiO4: Mn 3.0 μm 50 wt. % | NONE | ETHYL CELLULOSE CONTAINING 49% OF ETHOXY GROUP | (B): 0.5 wt. % (R): 0.2 wt. % (G): 1.5 wt. % | TERPINEOL AND BUTYL CARBITOL ACETATE (l/l) | (B): 49.7 wt. % (R): 39.8 wt. % (G): 48.5 wt. % |

TABLE 8

| REFERENCE NUMBER | TYPE OF CHARGE-REMOVING MATERIAL | ADDED AMOUNT OF CHARGE-REMOVING MATERIAL | VISCOSITY OF INK (CENTIPOISE) | PANEL LUMINANCE cd/m2 | LINE BLURRING? |
|---|---|---|---|---|---|
| 31 | ESTER PHOSPHATE GROUP (ANANIONIC GROUP) 'PLYSERVE' A207H (DAI-ICHI KOGYO SEIYAKU CO., LTD) | (B): 0.7 wt. % (R): 0.8 wt. % (G): 0.5 wt. % | 25 | 531 | NONE |
| 32 | LAURYL BETAINE (ANIONIC TYPE) 'AMPHITOL' 24B (KAO CORPORATION) | (B): 0.6 wt. % (R): 0.7 wt. % (G): 0.5 wt. % | 20 | 545 | NONE |
| 33 | POLYCARBOXLATE POLYMER (ANIONIC TYPE) 'HOMOGENOL' L100 (KAO CORPORATION) | (B): 0.05 wt. % (R): 0.8 wt. % (G): 0.7 wt. % | 80 | 541 | NONE |
| 34 | POLYOXYETHYLENE ALKYLAMINE (NONIONIC GROUP) 'AMIET' 105 (KAO CORPORATION) | (B): 0.05 wt. % (R): 0.8 wt. % (G): 0.7 wt. % | 10 | 547 | NONE |
| 35 | ALKYL PHOSPHATE (ANIONIC TYPE) | (B): 0.5 wt. % (R): 0.5 wt. % (G): 0.5 wt. % | 28 | 548 | NONE |
| 36 | (CATIONIC TYPE) QUARTAMIN 24-P | (B): 0.6 wt. % (R): 0.4 wt. % (G): 0.5 wt. % | 24 | 543 | NONE |

TABLE 8-continued

| REFERENCE NUMBER | TYPE OF CHARGE-REMOVING MATERIAL | ADDED AMOUNT OF CHARGE-REMOVING MATERIAL | VISCOSITY OF INK (CENTIPOISE) | PANEL LUMINANCE cd/m2 | LINE BLURRING? |
|---|---|---|---|---|---|
| 37 | STEARYL BETAINE (CATIONIC TYPE) 'AMPHITOL' 86B KAO CORPORATION | (B): 0.5 wt. % (R): 0.5 wt. % (G): 0.5 wt. % | 30 | 547 | NONE |

TABLE 9

| REFERENCE NUMBER | TYPE AND PARTICLE DIAMETER OF CONDUCTIVE FINE PARTICLES | ADDED AMOUNT OF CONDUCTIVE FINE PARTICLES | VISCOSITY OF INK (CENTIPOISE) | PANEL LUMINANCE cd/m2 | LINE BLURRING? |
|---|---|---|---|---|---|
| 38 | SnO2 PARTICLE DIAMETER 0.05 μm | (B): 1.0 wt. % (R): 1.0 wt. % (G): 1.0 wt. % | 100 | 530 | NONE |
| 39 | InO2 PARTICLE DIAMETER 0.05 μm | (B): 1.0 wt. % (R): 1.0 wt. % (G): 1.0 wt. % | 250 | 543 | NONE |
| 40 | InO2 PARTICLE DIAMETER 0.05 μm | (B): 0.1 wt. % (R): 0.1 wt. % (G): 0.1 wt. % | 352 | 535 | NONE |
| 41 | PARTICLE DIAMETER 0.01 μm | (B): 0.1 wt. % (R): 0.1 wt. % (G): 0.1 wt. % | 49 | 530 | NONE |
| 42 | Ag PARTICLE DIAMETER 0.01 μm | (B): 0.1 wt. % (R): 0.1 wt. % (G): 0.1 wt. % | 48 | 545 | NONE |
| 43 | NONE | | 30 | 465 | YES |

Tables 6 and 7 show the particle diameter and type of the phosphors, the type and amount of oxide applied to the phosphors, the type and amount of resin, the type and amount of solvent, and other such information. The type of surface-active agents and charge-removing material, the added amount, and the viscosity (a viscosity where the shear rate at 25° C. is 100 $sec^{-1}$) of the phosphor ink during application are shown in Tables 8 and 9.

A nozzle with a diameter of 50 μm was used, and the tip of the nozzle was kept at a distance of 1 mm from the back glass substrate during the application of the phosphor inks. All other aspects were the same as for the PDPs of the first set of tests.

Note that in the present tests, the surface of the back glass substrate on which the partition walls have been formed is exposed for between 10 seconds and one minute using an excimer lamp (producing light with a central wavelength of 172 nm) before the phosphor ink is applied to improve the application of the ink. Also, after the phosphor layer has been baked, the surface of the back glass substrate 21 on which the phosphor layer has been formed is once again exposed to excimer lamp (producing light with a central wavelength of 172 nm) for between 10 seconds and one minute to remove any binder or other residue from the phosphor layer.

The PDPs manufactured in this way were driven, and the panel luminance and presence of line blurring were examined.

Panel luminance was measured using a luminance meter with the PDPs being driven using a discharge sustaining voltage (frequency 30 Hz) of 150V. The presence or absence of line blurring was examined by having the entire panel display the color white and observing the results using the naked eye.

The wavelength of the ultra-violet light emitted when these PDPs were driven was found to be roughly equal to the excitation wavelength of a xenon molecular beam that is centered on 173 nm.

The results of these experiments are shown in Tables 8 and 9.

As shown in Tables 8 and 9, Examples 31 to 42 had a higher panel luminance than Example 43. While line blurring was observed for Example 43, no such blurring occurred for Examples 31 to 42.

When the phosphor layer formed in the PDPs was examined, no mixing of phosphors of different colors was observed, though in Examples 31 to 42 the application of phosphor ink to the side faces of the partition walls was more favorable than in Example 43.

Remarks

The above test results for panel luminance and line blurring are thought to be due to the favorable balance between the amount of phosphor ink on the side faces of the partition walls and the amount of phosphor ink in the bottom of the channels in the Examples 31 to 42 where a charge-removing material was added to the phosphor inks. Such balance was not achieved in example 43, where no charge-removing material was added.

Second Embodiment

Figure 12:
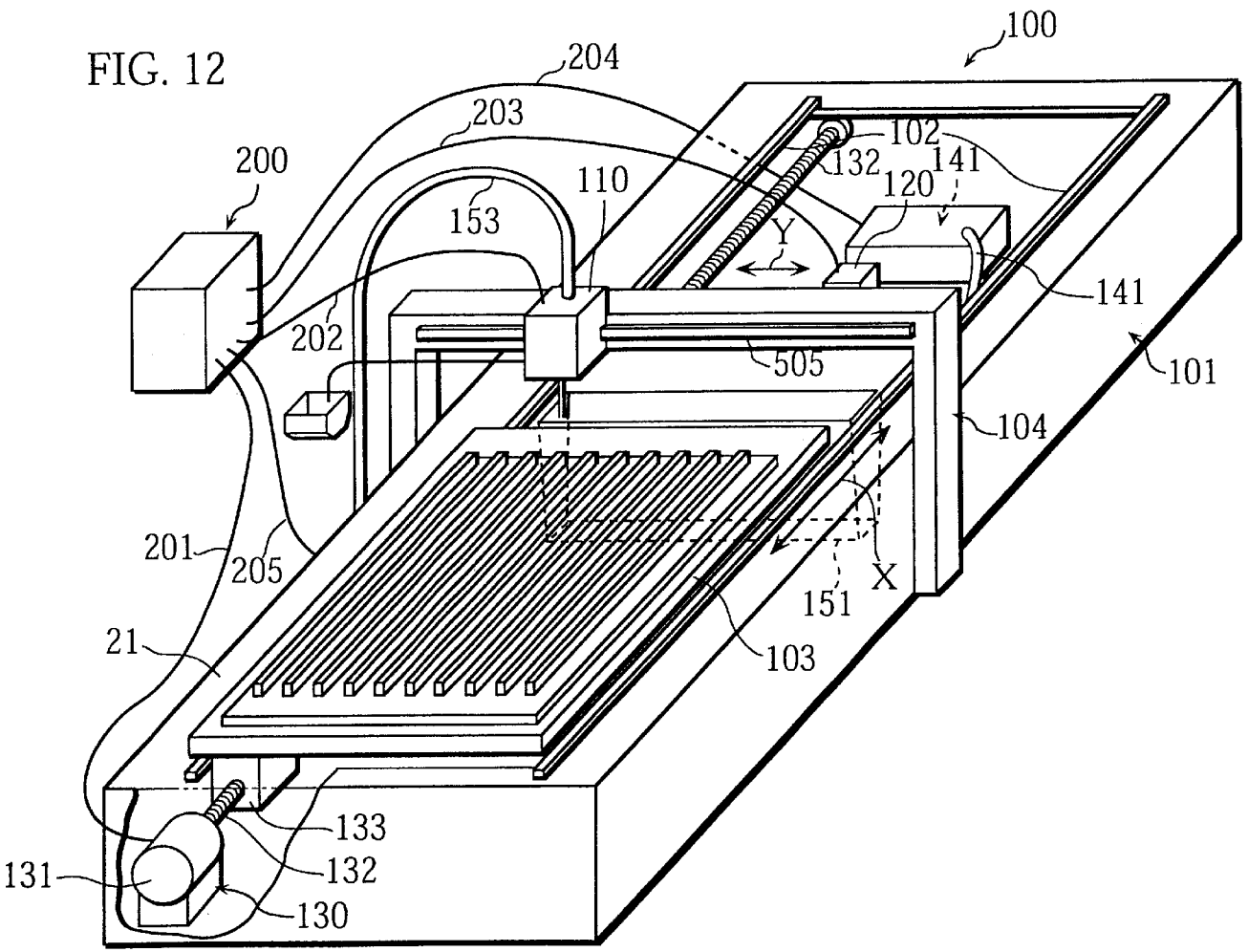
FIG. 12 is a perspective drawing of the ink application apparatus of the second embodiment of the present invention.
Figure 13:
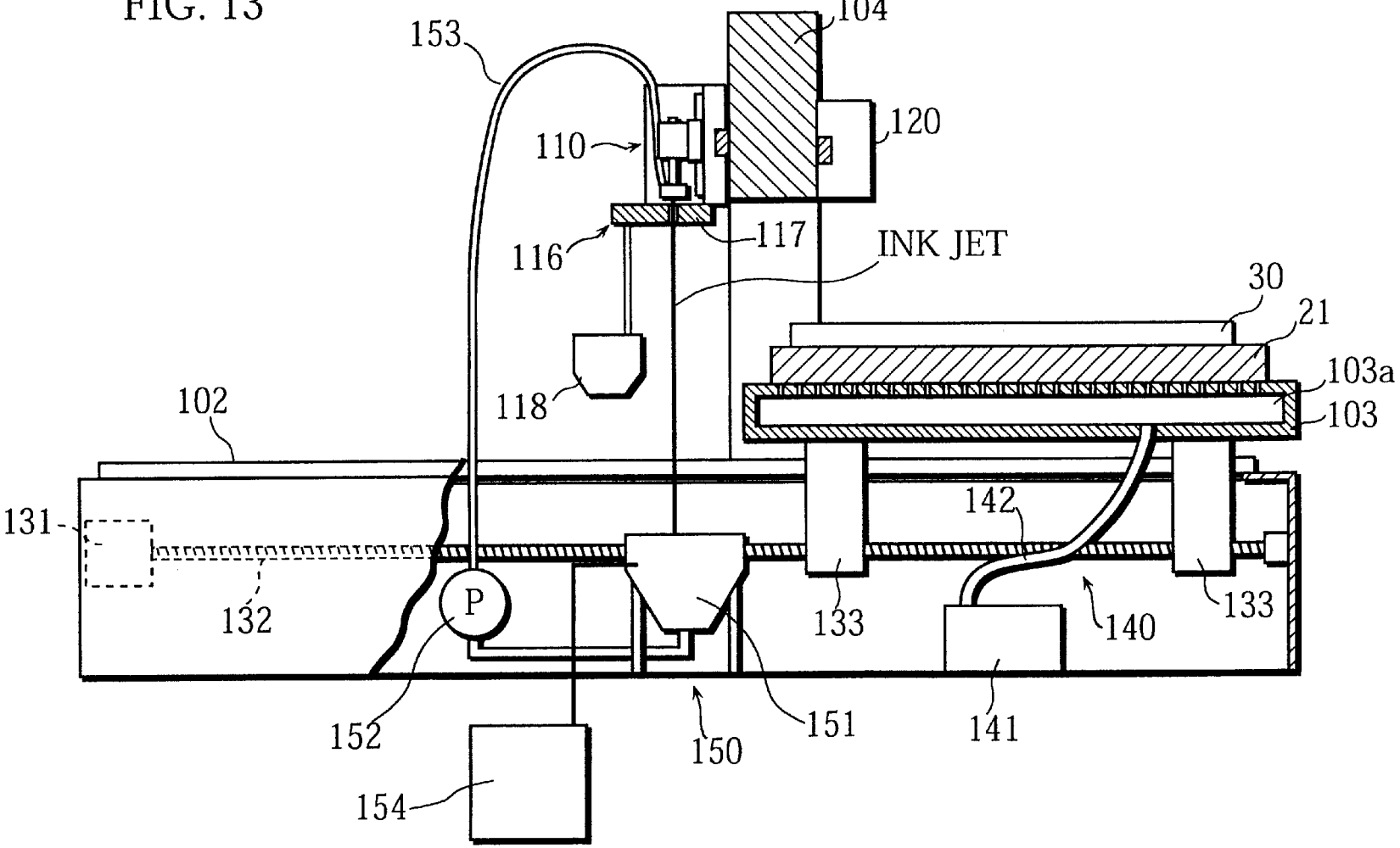
FIG. 13 shows a frontal elevation (partially in cross-section) of this ink application apparatus.

FIG. 12 is a perspective drawing of the ink application apparatus of the present embodiment, while FIG. 13 shows a frontal elevation (partially in cross-section) of this ink application apparatus.

This ink application apparatus has fundamentally the same construction as the ink application apparatus 50 described earlier, though it further includes other mechanisms, such as a circulating mechanism that collects and uses phosphor ink and a nozzle revolving mechanism that revolves a nozzle head including a plurality of nozzles to adjust the nozzle pitch.

Construction of the Ink Application Apparatus

The present ink application apparatus is composed of a main body 100 and a controller 200.

The main body 100 includes a main base 101, a rail 102 laid on the upper surface of the main base 101, a substrate mounting stand 103 that moves along the rail 102 in the X-axis (shown by the arrow X in the drawing), an arm 104 provided so as to cross the main base 101, a nozzle head unit 110 that moves in the Y-axis (shown by the arrow Y in the drawing) along a rail 105 provided on the arm 104, and a photographic unit 120 that moves the arm 104 in the Y-axis and detects positions between the partition walls on a back glass substrate 21 that has been placed on the substrate mounting stand 103.

An X-axis driving mechanism 130 is provided on the inside of the main base 101 for driving the substrate mounting stand 103 back and forth in the X-axis.

The X-axis driving mechanism 130 includes a driving motor 131 (for example a servo motor or a stepping motor), a feed screw 132 that extends in the X-axis along the rail 102, and a nut 133 that is attached to the bottom of the substrate mounting stand 103. The feed screw 132 is driven by the driving motor 131 and so slides the nut 133 and substrate mounting stand 103 at high speed in the X-axis.

Figure 14:
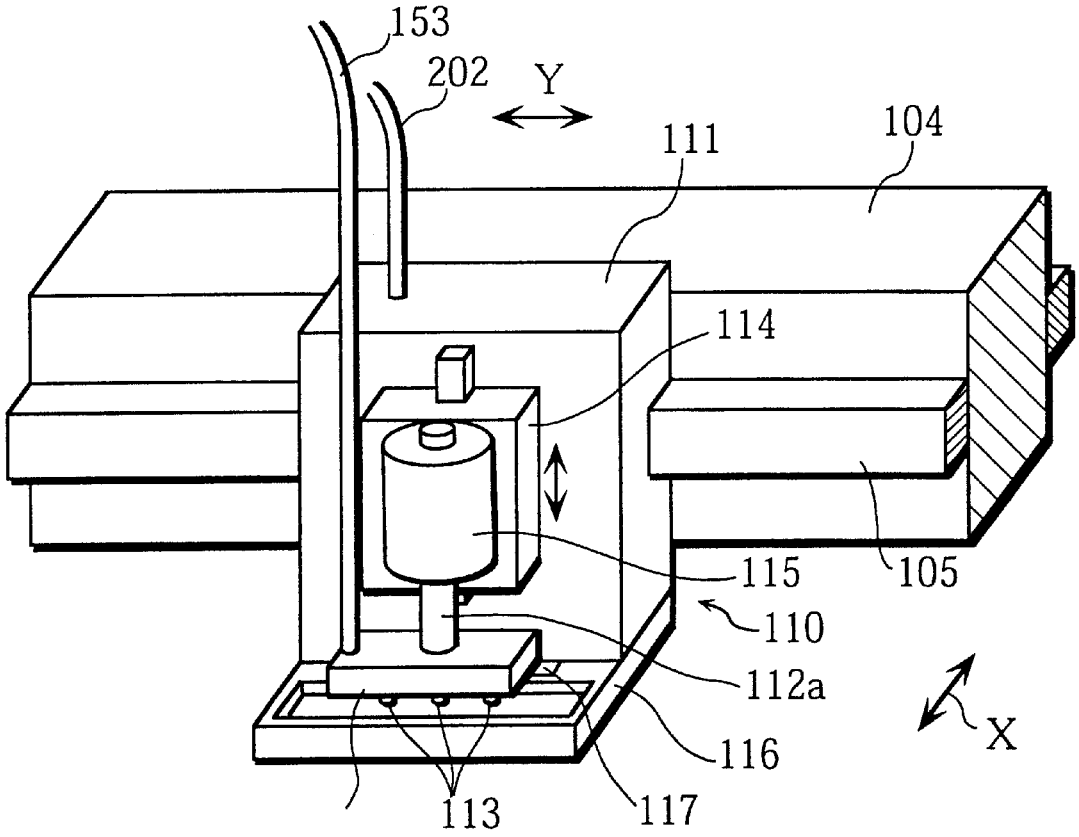
FIG. 14 shows an enlargement of the nozzle head unit shown in FIG. 12.

FIG. 14 is an expanded view of the nozzle head unit 110 shown in FIG. 12.

The nozzle head unit 110 includes a driving base unit 111 that includes a Y-axis driving mechanism for driving the nozzle head unit 110 back and forth in the Y-axis, a nozzle head 112 on which a plurality of nozzles 113 are aligned, a raising/lowering mechanism 114 for adjusting the height of the nozzle head 112, and a rotational driving mechanism 115 for rotating the nozzle head 112 within a plane that is parallel with the substrate mounting stand 103. As one example, a slide mechanism that is a combination of a rack gear and linear motor or a driving motor fitted with a pinion gear can be used as the Y-axis driving mechanism and the raising/lowering mechanism 114. The rotational driving mechanism 115 can be a servo motor, for example, which rotates about the rotational axis 112*a* of the nozzle head 112.

Like the driving base unit 111, the photographic unit 120 is capable of moving the arm 104 by means of a Y-axis driving mechanism. In the same way as the channel detecting head 55 of the first embodiment, this photographic unit 120 is provided with a CCD line sensor or the like that extends in the Y-axis, and so is capable of obtaining image data for the upper surface of the back glass substrate 21 when the back glass substrate 21 is placed on the substrate mounting stand 103.

While not illustrated, the ink application apparatus is also equipped with an X-position detecting mechanism for detecting the position of the substrate mounting stand 103 in the X-axis, a Y-position detecting mechanism for detecting the position of the nozzle head unit 110 and the photographic unit 120 in the Y-axis, and linear sensors (such as optical linear encoders) positioned in the Y-axis, the X-axis and above and below as a height detecting mechanism for detecting the height of the raising/lowering mechanism 114.

Based on the signals from these linear sensors, the controller 200 can always know the positions of the nozzle head unit 110 and the photographic unit 120 (the position of the,photographic unit 120 being X and Y coordinates on the substrate mounting stand 103), as well as the height of the nozzle head 112. The controller 200 can also know the angle θ made by the nozzle head 112 with respect to the X-axis using an angle detecting mechanism (such as a rotary encoder).

The driving mechanisms and detecting mechanisms described above enable the nozzle head 112 and the photographic unit 120 to scan the substrate mounting stand 103 in the X- and Y-axes, with adjustment being possible for the height of the nozzle head 112 above the substrate mounting stand 103 and the angle made by the nozzle head 112 with respect to the X-axis.

As shown in FIGS. 12 and 13, a plate suction mechanism 140 is provided for applying a suction force to a plate placed on the substrate mounting stand 103. This plate suction mechanism 140 is achieved by a suction pump 141 and a flexible hose 142 that connects the suction pump 141 to the substrate mounting stand 103. Both the suction pump 141 and the flexible hose 142 are provided on the inside of the main base 101. A hollow 103*a* (see FIG. 13) is provided on the inside of the substrate mounting stand 103, and the upper surface of the substrate mounting stand 103 is provided with a large number of perforations that connect the upper surface to the hollow 103*a*. When the suction pump 141 pumps air from the hollow 103*a*, a suction force is applied to a plate that has been placed on the substrate mounting stand 103.

As shown in FIGS. 12 and 13, a circulating mechanism 150 for collecting and circulating phosphor ink (jetted ink) that has been expelled from the nozzle head unit 110 is provided within the main body 100.

The circulating mechanism 150 is composed of a collecting vessel 151 for collecting the phosphor ink that has been expelled from the nozzle head unit 110 and a pressurizing pump 152 for applying pressure to the phosphor ink in the collecting vessel 151 so as to supply the phosphor ink.

The collecting vessel 151 extends in the Y-axis so as to collect ink that has been expelled across the entire scanning length of the nozzle head unit 110. Ink that has been collected in this way is supplied by the pressurizing pump 152 via the pipe 153 to the nozzle head 112 in the nozzle head unit 110 and is so reused by the apparatus.

The circulating mechanism 150 is also provided with an ink supplier 154 that keeps the amount of phosphor ink circulating within the apparatus at a suitable level. The ink supplier 154 monitors whether the amount of ink in the collecting vessel 151 is at least equal to a predetermined level and automatically supplies extra phosphor ink when the amount falls below this level.

A jet shielding mechanism 116 is also provided in the nozzle head unit 110 to prevent ink that has been jetted from the nozzle head 112 sticking to the sides of the back glass substrate 21.

The jet shielding mechanism 116 is composed of a shielding tray 117 that slides in the X-axis and a solenoid (not illustrated) that drives the shielding tray 117. The shielding tray 117 is usually placed away from the path taken by the ink jets, but can be slid to a position where it blocks the ink jets. Phosphor ink that strikes the shielding tray 117 when it is in the blocking position is sent by a suction pump (not illustrated) to the second vessel 118.

The controller 200 controls all of the components of the main body 100. The controller 200 is connected to the driving motor 131, the nozzle head unit 110, the photographic unit 120, the suction pump 141 and the pressurizing pump 152 by the cables 201 to 205, and drives these components using power and driving signals that are supplied from the controller 200 via these cables.

The image data obtained by the photographic unit 120 is supplied to the controller 200 via the cable 203.

Operation of the Ink Application Apparatus and its Control Procedures

The following explains the procedure used when applying phosphor ink using an apparatus of the above construction.

First the back glass substrate 21 is placed on the substrate mounting stand 103 and the suction pump 141 is operated to apply a suction force that holds the back glass substrate 21 on the substrate mounting stand 103.

In the same way as the ink application apparatus 50 described in the first embodiment, the photographic unit 120 is made to scan the back glass substrate 21 to gather image information for the entire surface of the back glass substrate 21. Based on the image data obtained from the photographic unit 120, the controller 200 obtains image data that associates coordinate positions on the substrate mounting stand 103 with detected luminance values, and sets the scanning lines in the channels between the partition walls.

After this, the controller 200 drives the raising/lowering mechanism 114 to adjust the height of the nozzle head 112, i.e., to adjust the distance between the lower tip of the nozzles 113 and the upper surfaces of the partition walls 30. The controller 200 then drives the pressurizing pump 152 to have phosphor ink expelled from the nozzle head unit 110. The nozzle head unit 110 is made to scan as described below while phosphor ink is being expelled to apply the ink to the back glass substrate 21.

Figure 15:
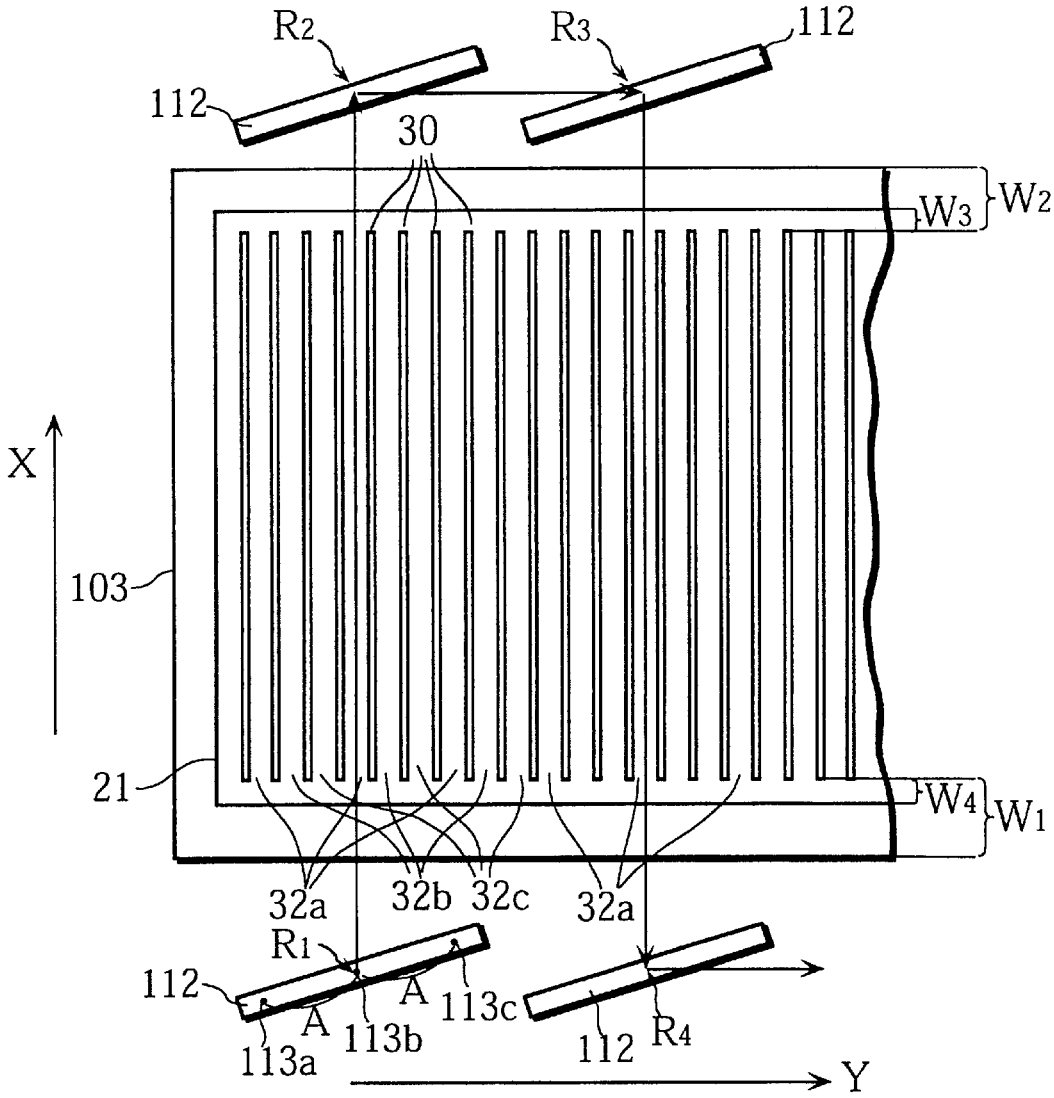
FIG. 15 shows how the nozzle head of this ink application apparatus scans the back glass substrate.

FIG. 15 shows how the nozzle head 112 scans the back glass substrate 21.

The following explanation deals with the case where the same colored ink (blue) is applied to every third channel 32*a*.

Three nozzles 113*a*, 113*b*, and 113*c* are aligned in a straight line on the nozzle head 112 at intervals equal to the distance A. This nozzle interval A is set slightly larger than the pitch of channels 32*a* (i.e., triple the channel pitch) and the center nozzle 113*b* is positioned at the axis of rotation of the nozzle head 112.

The nozzle head 112 scans the back glass substrate 21 with its center following the lines shown by the arrows R1 to R4 in FIG. 15.

As shown in FIG. 15, the nozzle head 112 is tilted with respect to the Y-axis, with the nozzles 113*a*, 113*b*, and 113*c* positioned over channels 32*a* that are separated by two channels. In this state, the nozzle head 112 scans the back glass substrate 21 in the X-axis by moving from R1 to R2. Next, the nozzle head 112 is moved in the Y-axis by a distance equal to nine times the pitch of the partition walls (R2 to R3). Tilted with respect to the Y-axis as before, the nozzle head 112 then scans the back glass substrate 21 in the X-axis (R3 to R4).

Hereafter, scanning is repeated in the same way for the entire back glass substrate 21 to apply phosphor ink to every channel 32*a*. During this time, the pressurizing pump 152 is continuously driven so that phosphor ink is continuously expelled. This stops ink from building up on the lower surface of the nozzles 113*a*, 113*b*, and 113*c*, which would interfere with the ink jets.

During scanning in the X-axis, while the nozzle head 112 passes between the ends of the partition walls 30 and the edge of the substrate mounting stand 103 (the areas shown as W1 and W2 in FIG. 15), the jet shielding mechanism 116 is driven to move the shielding tray 117 so as to block the ink jets. As a result, phosphor ink is not applied to the areas beyond the ends of the partition walls 30 on the back glass substrate 21 (the areas shown as W3 and W4) in FIG. 15.

When the viscosity of the phosphor ink is low and ink that is intended for the channels 32*a* is applied beyond the ends of the partition walls 30, there is the risk of such ink flowing into adjacent channels 32*b* and 32*c* and mixing with the different colored inks applied there. However, since the application of ink beyond the ends of the partition walls 30 is stopped as described above, such mixing of ink is avoided.

The jet shielding mechanism 116 needs to be constructed so that the shielding tray 117 can be inserted between the lower tips of the nozzles 113 and the upper surfaces of the partition walls 30. While it may appear preferable for the shielding tray 117 to be made thin, the shielding tray 117 needs to be sufficiently thick so as to support a reasonable amount of phosphor ink. It is also preferable for the raising/lowering mechanism 114 to be driven in synchronization with the jet shielding mechanism 116 so as to lift the nozzle head 112 out of the way.

If ink is continuously circulated in the apparatus during application, the amount of ink in the vessel is likely to decrease and its properties are likely to change due to factors such as the evaporation of solvent. For this reason, an arrangement that keeps the properties of the phosphor ink within a permissible range should be used. As one example, a solvent supplying mechanism may be provided for detecting the viscosity of the ink in the collecting vessel 151 and automatically supplying solvent to the phosphor ink when necessary. In this way, the viscosity of the phosphor ink can be kept constant. This also enables ink to be applied in a stable manner for long periods.

The ink that gathers on the jet shielding mechanism 116 often has different properties to the ink that is simply collected by the collecting vessel, so that it is preferable for the ink that gathers on the jet shielding mechanism 116 to be managed in the second vessel 118 and to be reused in a manner that is separate from the circulating ink.

Positional Control of the Nozzle Head 112

When the nozzle head 112 is scanning in the X-axis, control is performed in the same way as in the first embodiment to adjust the position of the nozzle head 112 in the Y-axis. The rotational driving mechanism 115 also rotates the nozzle head 112 during scanning to adjust the pitch of the nozzles in the Y-axis.

In more detail, the position of the nozzle head 112 in the Y-axis and its rotational angle are adjusted during scanning in the X direction so that the end nozzles 113*a* and 113*c*, out of the nozzles 113*a*, 113*b*, and 113*c*, follow the centers of the corresponding channels 32*a*. By controlling the nozzle head 112 in this way, the nozzles 113*a*, 113*b*, and 113*c* on the nozzle head 112 can be made to follow scanning lines set in the centers of the channels 32*a*, even when the channels 32*a*, 32*b*, and 32*c* are bent or there are fluctuations in the pitch of the partition walls. A specific example of this control is given below.

Figure 16:
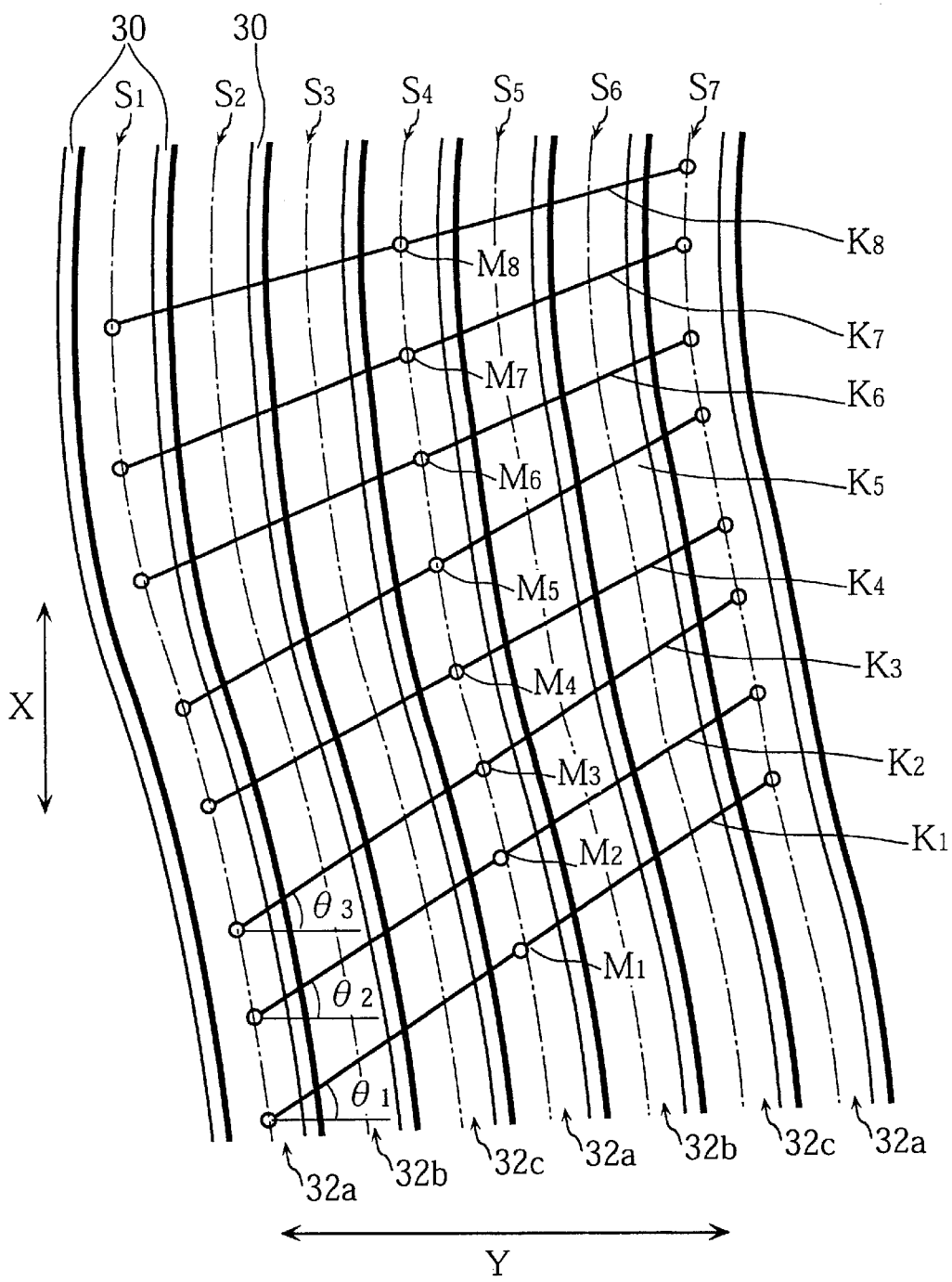
FIG. 16 shows an example of an enlargement of the image data obtained when the above ink application apparatus detects the channels.

FIG. 16 shows an enlarged representation of image data that associates coordinate positions on the substrate mounting stand 103 with luminance data. In this example, the channels 32*a*, 32*b* and 32*c* are bent with respect to the X-axis.

Scanning lines S1, S2, S3, . . . are set in the same way as was described in the first embodiment with reference to FIG. 5. As shown in FIG. 16, line segments K1, K2, K3, . . . that have the same length 2A and have their ends respectively positioned on the scanning lines S1 and S7 are set with an approximately equal pitch.

Next, the center points M1, M2, M3, . . . and the angles θ1, θ2, and θ3 made with the X-axis are calculated for the line segments K1, K2, K3 . . .

A line that joins the calculated center points M1, M2, M3, . . . is set as the scanning line (head scanning line) for the nozzle head 112. As can be understood from FIG. 16, while the head scanning line will veer somewhat away from the nozzle scanning line S4, these lines are still quite close to one another.

When the nozzle head 112 is scanning, the Y-axis driving mechanismof the nozzle head unit 110 is controlled so that the rotational center (nozzle 113*b*) of the nozzle head 112 follows the head scanning line (the line that passes through center points M1, M2, M3, . . . ) while the nozzle head 112 moves in the X-axis. At the same time, when the rotational center (nozzle 113*b*) of the nozzle head 112 reaches the center points M1, M2, M3 . . . calculated above, the angle made by the nozzle head 112 with respect to the X-axis is controlled by driving the rotational driving mechanism 115 so as to match the calculated angles θ1, θ2, θ3, . . .

When the nozzle head 112 is scanning, the position in the Y-axis and rotational angle θ are controlled in this way so that the end nozzles 113*a* and 113*c* follow the scanning lines S1 and S7, while the center nozzle 113*b* following the head scanning line (a line that is close to the nozzle scanning line S4). As a result, the nozzles 113*a,* 113*b* and 113*c* all scan the back glass substrate 21 close to the centers of the channels 32*a.*

Effects Achieved by Providing a Mechanism for Collecting Phosphor Ink

When the nozzles are not positioned above the channels on the back glass substrate 21, which is to say, when the plate is positioned in a standby position as shown in FIG. 13, the expelled ink is collected by the collecting vessel 151, so that phosphor ink can be continuously expelled from the nozzles without significant waste.

As one example, if ink is continuously expelled while the back glass substrate 21 on the substrate mounting stand 103 is being changed, ink can be applied in a stable manner to a plurality of back glass substrates 21 without wasting much phosphor ink.

The expelling of ink is fundamentally only stopped during maintenance. Ink can therefore be expelled continuously for 24 hours or more at a manufacturing plant. In some cases, ink can be continuously expelled for several weeks or months.

With the application method of the present embodiment, phosphor ink can be evenly and consistently applied to channels between partition walls with little waste. This makes the method highly suitable for mass production, and enables manufacturing costs to be reduced.

Modifications to the Present Embodiment

To make the apparatus more adaptable in case of changes to the operational procedure, it is favorable for the nozzle head unit 110 and the photographic unit 120 of the apparatus to be capable of independent movement on the arm 104 as shown in FIG. 12. However, the apparatus may still be operated as described above if the nozzle head unit 110 and the photographic unit 120 are integrally formed.

Figure 17:
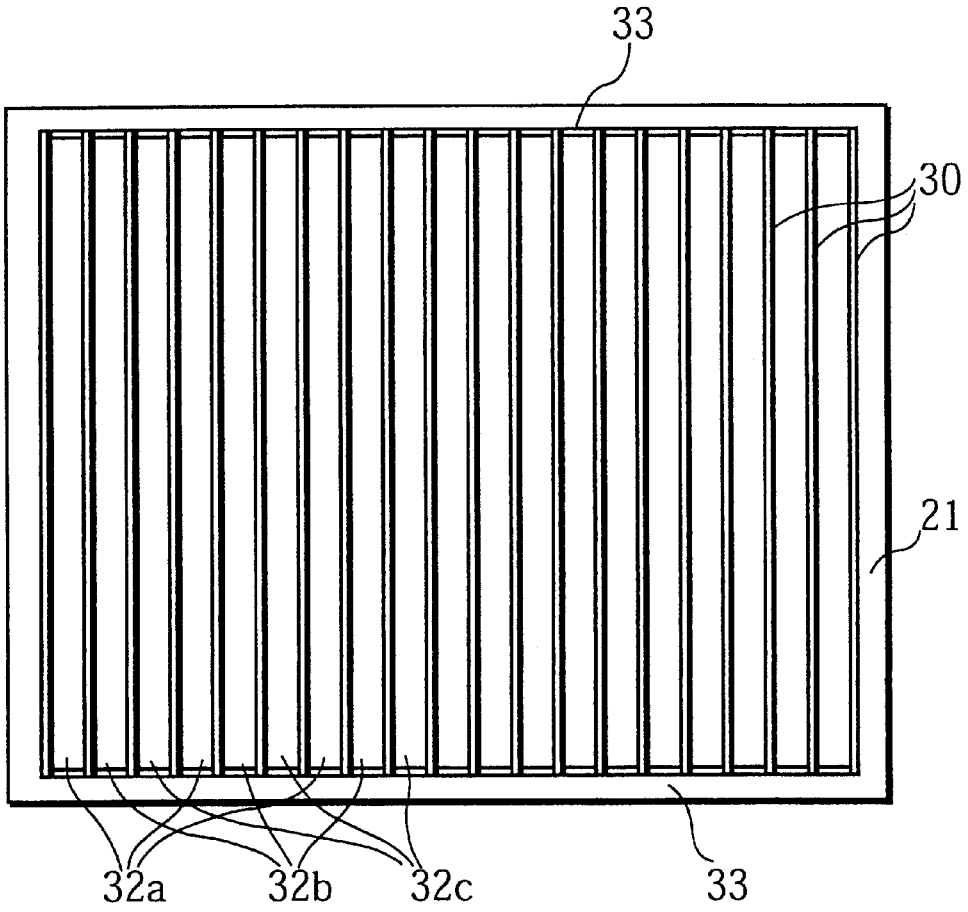
FIG. 17 shows a modification to the second embodiment.

The above embodiment describes the case where the ink jets are blocked near the edges of the back glass substrate 21 to prevent mixing of the phosphor ink. However, as shown in FIG. 17, supplementary partitions 33 may be provided on the back glass substrate 21 at both ends of the partition walls 30 so as to close the ends of the channels 32*a,* 32*b* and 32*c.* In this case, even if the phosphor ink applied to the channels 32*a* were to be applied to the edges of the back glass substrate 21, such ink would not flow into the adjacent channels 32*b* and 32*c* and mix with other phosphor inks.

Third Embodiment

The ink application apparatus of the present embodiment is similar to the ink application apparatus of the second embodiment, but has a different circulating mechanism for circulating phosphor ink.

Figure 18:
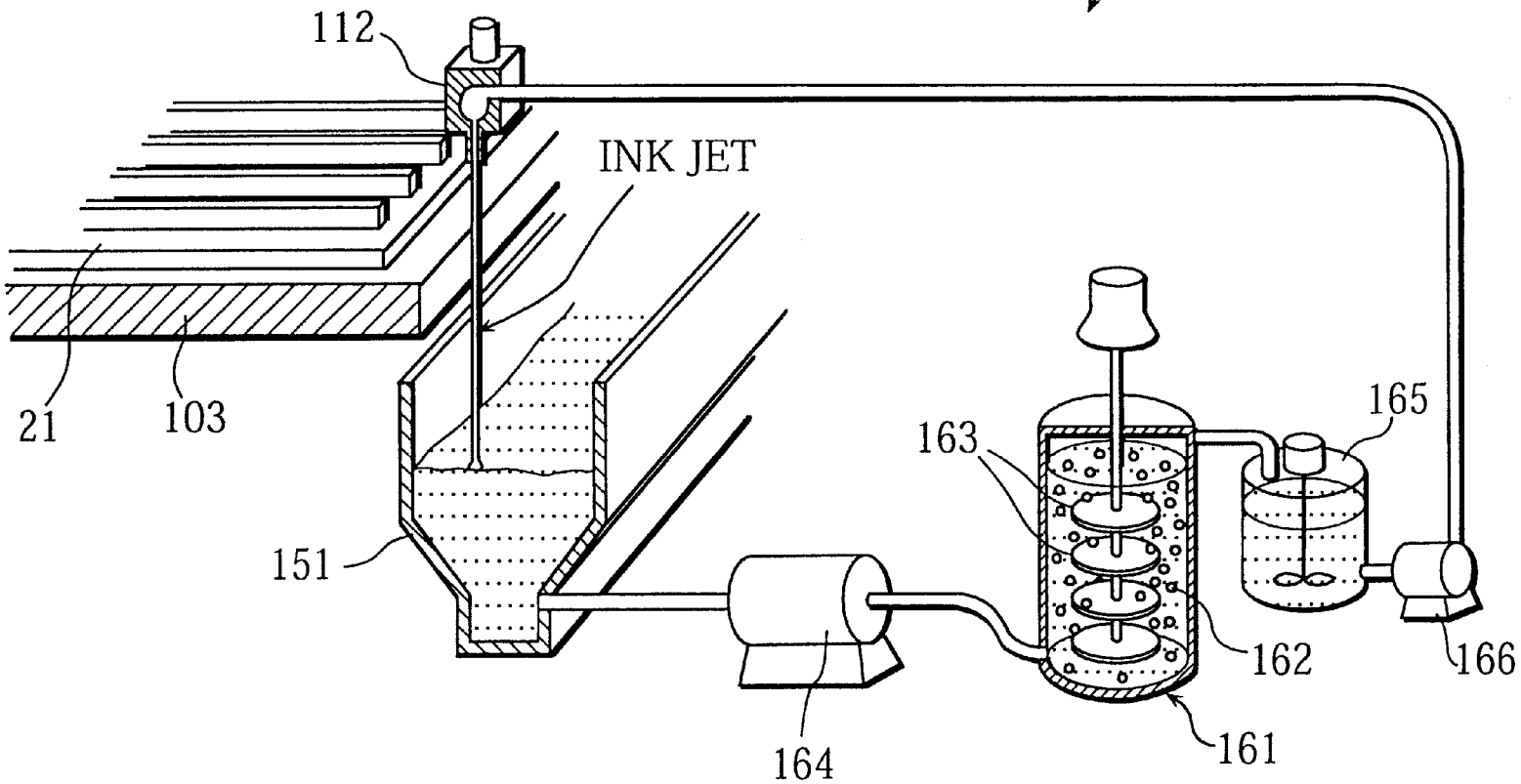
FIG. 18 shows the construction of a phosphor ink circulating mechanism that is used in the ink application apparatus of the third embodiment.

FIG. 18 shows the construction of the ink circulating mechanism in the ink application apparatus of the present embodiment.

Like the circulating mechanism 150 of the second embodiment, the circulating mechanism 160 collects phosphor ink that has been expelled by the nozzles 113 of the nozzle head 112 using a collecting vessel 151 and supplies the phosphor ink that has been collected back to the nozzle head 112. However, a disperser 161 is also provided on the supply route from the collecting vessel 151 to the nozzle head 112.

The disperser 161 is a sand mill in the form of a flow pipe that is filled with zirconia beads with a particle diameter of 2 mm or less. The rotation discs 163 spin at 500 rpm or below in a predetermined direction so that the beads stir the phosphor ink flowing inside the disperser 161, thereby dispersing the phosphor particles in the phosphor ink.

The circulating mechanism 160 also includes a circulating pump 164 for pumping the phosphor ink in the collecting vessel 151 to the disperser 161, a server 165 for storing the phosphor ink that has passed through the disperser 161, and a pressurizing pump 166 for applying pressure to this phosphor ink to supply it to the nozzle head 112.

With the above mechanism, the phosphor ink that collect's in the collecting vessel 151 is dispersed by the disperser 161 before being supplied to the nozzle head 112.

Note that the disperser 161 can be alternatively realized by an attriter, a jet mill, or the like.

When the phosphor ink is left for a long time after manufacturing, there are cases where there is deterioration in the dispersed state of the phosphor particles. If phosphor ink is circulated using the circulating mechanism 150 described above in the second embodiment, there are cases where the dispersed state of the ink deteriorates and secondary aggregates are formed. This can lead to blockage of the nozzles and deterioration in the application of the phosphor ink to the channels 32. However, by redispersing the phosphor ink immediately before expulsion, the circulating mechanism 160 of the present embodiment overcomes such problems.

The favorable effect of redispersing the phosphor ink is not limited to when the phosphor ink is redispersed within the ink redispersing mechanism. In general, such effect can also be achieved when the phosphor ink is redispersed between manufacturing and application depending on the conditions described below.

The following describes the favorable conditions for the treatment of the phosphor ink from manufacturing to application.

Figure 19:
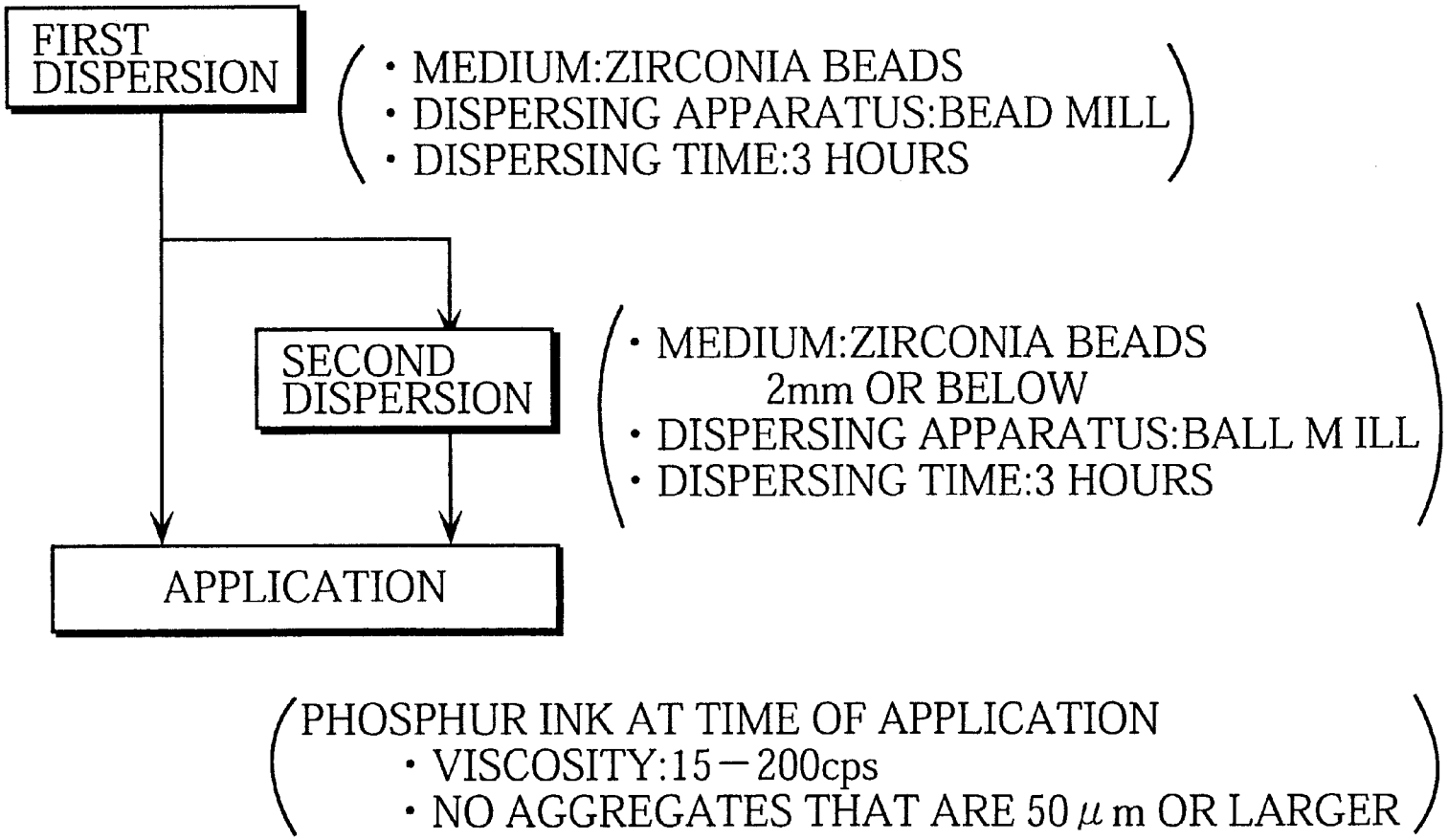
FIG. 19 shows the processes performed from the manufacture of the phosphor ink to the application of the phosphor ink.

FIG. 19 shows the treatment of the phosphor ink between manufacturing and application.

When the phosphor ink is manufactured, the phosphor powders of the various colors that are used in the phosphor inks are mixed with resin and solvent and dispersed (first dispersion).

When this first dispersion is performed using a dispersion apparatus that uses a dispersion medium (examples of such apparatuses being a sand mill, a ball mill, and a bead mill), it is preferable to use zirconia beads with a particle diameter of 1.0 mm or below as the dispersion medium, and to perform the dispersion for a relatively short time of three hours or less using a bead mill. This limits the damage caused to the phosphor particles and avoids contamination with impurities.

It is preferable for the viscosity of the phosphor ink to be adjusted so as to be in a range of about 15 to 200 cp and for the ink to include no aggregates whose diameter is half the nozzle diameter or larger.

If a phosphor ink that has been manufactured in this way is set in an ink application apparatus immediately after manufacturing, the ink can be applied with the phosphor particles still being favorably dispersed as a result of the first dispersion. As a result, ink can be evenly applied to each channel in an preferable state without redispersion of the phosphor particles. To set the ink in the ink application apparatus immediately after manufacturing, the dispersion apparatus for the phosphor ink and the ink application apparatus can be provided in the same manufacturing facility, with the manufactured phosphor ink being set in the ink application apparatus and then applied.

In terms of time, it is preferable for the phosphor ink to be applied within several hours of manufacturing, and within one hour of manufacturing if possible.

On the other hand, if the phosphor ink is set in the ink application apparatus a long time after manufacturing, the ink ends up being applied long after the first dispersion. In the intervening period, the ink becomes less dispersed and secondary aggregates can be produced. If such ink is supplied to the nozzle in this state, the ink will not be applied evenly to each channel. Blockage of the nozzles also becomes likely.

When a long time has passed from the manufacturing of the phosphor ink (i.e., from the first dispersion), subjecting the phosphor ink to a second dispersion process before setting the ink in an ink application apparatus enables the ink to be applied in a favorably dispersed state. In this case, ink can be evenly applied to each channel and blockages of the nozzle can be avoided.

The main purpose of the second dispersion is to disperse the secondary aggregates, so that a large shearing force is not required. Conversely, using a weak attrition force limits the damage caused to the phosphors.

For this reason, it is effective to use zirconia beads with a particle diameter of 2 mm or below and to perform the redispersion at 500 rpm or below for 6 hours or less. Zirconia beads are used to avoid contamination as in the first dispersion. Phosphor ink that has been subjected to a second dispersion in this way should preferably also have its viscosity adjusted to around 15 to 200 cps and should preferably contain no large aggregates with a diameter that is around half the nozzle diameter or larger.

Fourth Embodiment

Arrangement Related to First Dispersion

Various modifications were made to the dispersion method (type and diameter of the beads, dispersion time) used during the manufacturing (i.e. during the first dispersion) of phosphor inks of various colors, as shown in Table 10.

TABLE 10

| TYPE AND PARTICLE DIAMETER OF PHOSPHURS | COMPOSITION OF INK | DISPERSION METHOD | DISPERSION MEDIUM |
|---|---|---|---|
| $YGdBO_3$:Eu | PHOSPHURS: 60 wt % | BEAD MILL | GLASS BEADS: 2 mm |
| 3.0 μm | SOLVENT: 39 wt % | 60 min | ZIRCONIA BEADS: 0.2 mm |
| | ETHYL CELLULOSE: 1 wt % | | ZIRCONIA BEADS: 2 mm |
| $Zn_2SiO_4$:Mn | PHOSPHURS: 60 wt% | BEAD MILL | GLASS BEADS: 2 mm |
| 3.0 μm | SOLVENT: 39 wt% | 60 min | ZIRCONIA BEADS: 0.2 mm |
| | ETHYL CELLULOSE: 1 wt % | | ZIRCONIA BEADS: 2 mm |
| $BaMgAl_{10}O_{17}$:Eu | PHOSPHURS: 60 wt % | BEAD MILL | GLASS BEADS: 2 mm |
| 3.0 μm | SOLVENT: 39 wt% | 60 min | ZIRCONIA BEADS: 0.2 mm |
| | ETHYL CELLULOSE: 1 wt % | | ZIRCONIA BEADS: 2 mm |
| $YGdBO_3$:Eu | PHOSPHURS: 60 wt% | BEAD MILL: 15 min | ZIRCONIA BEADS: 0.2 mm |
| 3.0 μm | SOLVENT: 39 wt% | BEAD MILL: 30 min | ZIRCONIA BEADS: 0.2 mm |
| | ETHYL CELLULOSE: 1 wt % | BEAD MILL: 60 min | ZIRCONIA BEADS: 0.2 mm |
| $Zn_2SiO_4$:Mn | PHOSPHURS: 60 wt % | BEAD MILL: 15 min | ZIRCONIA BEADS: 0.2 mm |
| 3.0 μm | SOLVENT: 39 wt % | BEAD MILL: 30 min | ZIRCONIA BEADS: 0.2 mm |
| | ETHYL CELLULOSE: 1 wt % | BEAD MILL: 60 min | ZIRCONIA BEADS: 0.2 mm |
| $BaMgAl_{10}O_{17}$:Eu | PHOSPHURS: 60 wt % | BEAD MILL: 15 min | ZIRCONIA BEADS: 0.2 mm |
| 3.0 μm | SOLVENT: 39 wt % | BEAD MILL: 30 min | ZIRCONIA BEADS: 0.2 mm |
| | ETHYL CELLULOSE: 1 wt % | BEAD MILL: 60 min | ZIRCONIA BEADS: 0.2 mm |

| TYPE AND PARTICLE DIAMETER OF PHOSPHURS | LUMINANCE (cd/m2) | PARTICLE DIAMETER OF PHOSPHURS AFTER DISPERSION (μm) | COMMENTS |
|---|---|---|---|
| $YGdBO_3$:Eu | 247 | 1.5 | CONTAMINATED WITH Na, Ca, Si |
| 3.0 μm | 302 | 2.3 | NO CONTAMINANTS |
| | 291 | 1.8 | NO CONTAMINANTS |
| $Zn_2SiO_4$:Mn | 495 | 1.0 | CONTAMINATED WITH Na, Ca, Si |
| 3.0 μm | 576 | 1.8 | NO CONTAMINANTS |
| | 512 | 1.5 | NO CONTAMINANTS |
| $BaMgAl_{10}O_{17}$:Eu | 81.2 | 1.3 | CONTAMINATED WITH Na, Ca, Si |
| 3.0 μm | 88.0 | 2.1 | NO CONTAMINANTS |
| | 86.4 | 1.7 | NO CONTAMINANTS |
| $YGdBO_3$:Eu | 320 | 3.0 | AGGREGATES: PRESENT |
| 3.0 μm | 318 | 3.0 | AGGREGATES: NOT PRESENT |
| | 302 | 2.3 | AGGREGATES: NOT PRESENT |
| $Zn_2SiO_4$:Mn | 582 | 3.0 | AGGREGATES: PRESENT |
| 3.0 μm | 281 | 2.9 | AGGREGATES: NOT PRESENT |
| | 276 | 1.8 | AGGREGATES: NOT PRESENT |
| $BaMgAl_{10}O_{17}$:Eu | 89.0 | 3.0 | AGGREGATES: PRESENT |
| 3.0 μm | 89.2 | 3.0 | AGGREGATES: NOT PRESENT |
| | 88.0 | 2.1 | AGGREGATES: NOT PRESENT |

Each phosphor ink includes 60% by weight of phosphor particles with an average particle diameter of 3 μm, 1% by weight of ethyl cellulose, and a mixed solvent composed of terpineol and limonene.

Panel luminance, the particle diameter of the phosphor particles (measured after the first dispersion), and the presence or absence of aggregates were investigated for several phosphor inks that were manufactured.

Panel luminance was measured by baking the phosphor ink after dispersion in the presence of air at 500° C. to form a phospher layer, placing this in a vacuum chamber which was then evacuated, exposing the layer to ultraviolet light from an excimer lamp, and then measuring the light produced by excitation of the phosphors using a luminance meter.

The results of these tests are shown in Table 10.

As can seen from Table 10, the use of glass beads as the dispersing medium results in a reduction in luminance of each of the colors red, green and blue compared to when zirconia beads are used. Large amounts of sodium (Na), calcium (Ca), and silicon (Si) contaminants were also found when glass beads were used as the dispersing medium.

It is believed that the decrease in luminance caused when glass beads are used as the dispersing medium is due to the strong shearing force applied during dispersion impacting strongly on the glass beads, causing components of the glass to enter the ink as contaminants which reduce the amount of emitted light.

From the values given in Table 10, it can be seen that even when the same dispersing medium is used, luminance is affected by the particle diameter of the beads and the dispersion time. This is thought to be due to the following reasons. When the same shearing force is applied, the coefficient of the impacting force on the particles of dispersing medium depends on the diameter of the particles. When the same shearing force is applied but the dispersion time is short, the number of times the phosphor particles are subjected to impacts decreases.

From Table 10, it can be seen that the diameter of the phosphor particles is smaller after dispersion than before dispersion. This is because the dispersion process grinds the phosphor powder and weakens the boundary faces.

Arrangement Relating to the Second Dispersion

Phosphor inks of the various colors were left after manufacturing and then subjected to a second dispersion 72 hours after the first dispersion. As shown in Table 11, this second dispersion was performed for different lengths of time using zirconia beads of different diameters.

TABLE 11

| COLOR | TYPE AND PARTICLE DIAMETER OF PHOSPHURS | COMPOSITION OF INK | PRIMARY DISPERSION | LUMINANCE (cd/m2) AND PARTICLE DIAMETER AFTER PRIMARY DISPERSION |
|---|---|---|---|---|
| RED | $YGdBO_3$:Eu 3.0 μm | PHOSPHURS: 60 wt % SOLVENT: 39 wt. % ETHYL CELLULOSE: 1 wt % | BEAD MILL 30 MINUTES ZIRCONIA BEADS 0.2 mm | 316 PARTICLE DIAMETER: 3.0 μm |
| GREEN | $Zn_2SiO_4$:Mn 3.0 μm | PHOSPHURS: 60 wt % SOLVENT: 39 wt. % ETHYL CELLULOSE: 1 wt % | BEAD MILL 30 MINUTES ZIRCONIA BEADS 0.2 mm | 581 PARTICLE DIAMETER: 3.0 μm |
| BLUE | $BaMgAl_{10}O_{17}$:Eu 3.0 μm | PHOSPHURS: 60 wt % SOLVENT: 39 wt. % ETHYL CELLULOSE: 1 wt % | BEAD MILL 30 MINUTES ZIRCONIA BEADS 0.2 mm | 89.2 PARTICLE DIAMETER: 3.0 μm |

| COLOR | SECONDARY DISPERSION | DIAMETER OF ZIRCONIA BEADS (mm) | LUMINANCE (cd/m2) | PARTICLE DIAMETER OF PHOSPHURS AFTER DISPERSION | AGGREGATES PRESENT? |
|---|---|---|---|---|---|
| RED | BEAD MILL | 0.2 | 317 | 3.0 | PRESENT |
| | 30 MINUTES | 1 | 316 | 3.0 | PRESENT |
| | | 2 | 314 | 3.0 | PRESENT |
| | BEAD MILL | 0.2 | 318 | 3.0 | PRESENT |
| | 1 HOUR | 1 | 315 | 3.0 | PRESENT |
| | | 2 | 315 | 3.0 | NONE |
| | BEAD MILL | 0.2 | 313 | 3.0 | PRESENT |
| | 3 HOURS | 1 | 312 | 3.0 | LITTLE |
| | | 2 | 314 | 3.0 | NONE |
| GREEN | BEAD MILL | 0.2 | 581 | 3.0 | PRESENT |
| | 30 MINUTES | 1 | 580 | 3.0 | PRESENT |
| | | 2 | 581 | 3.0 | PRESENT |
| | BEAD MILL | 0.2 | 582 | 3.0 | PRESENT |
| | 1 HOUR | 1 | 582 | 3.0 | PRESENT |
| | | 2 | 581 | 3.0 | NONE |
| | BEAD MILL | 0.2 | 581 | 3.0 | PRESENT |
| | 3 HOURS | 1 | 583 | 3.0 | LITTLE |
| | | 2 | 582 | 3.0 | NONE |

TABLE 11-continued

| | | | | | |
|---|---|---|---|---|---|
| BLUE | BEAD MILL | 0.2 | 89.3 | 3.0 | PRESENT |
| | 30 MINUTES | 1 | 89.0 | 3.0 | PRESENT |
| | | 2 | 89.1 | 3.0 | PRESENT |
| | BEAD MILL | 0.2 | 89.1 | 3.0 | PRESENT |
| | 1 HOUR | 1 | 89.0 | 3.0 | PRESENT |
| | | 2 | 89.1 | 3.0 | NONE |
| | BEAD MILL | 0.2 | 89.2 | 3.0 | PRESENT |
| | 3 HOURS | 1 | 89.0 | 3.0 | LITTLE |
| | | 2 | 89.1 | 3.0 | NONE |

Luminance, the particle diameter of the phosphor powder (measured after the first dispersion), and the presence or absence of aggregates were investigated for phosphor inks that that had been subjected to a second dispersion. The results are shown in Table 11.

As is clear from Table 11, when the second dispersion is performed for less than one hour, aggregates are left in the red, green, and blue phosphor inks, though such aggregates are not observed when the dispersion time is increased. When the dispersion time is increased, no change is observed in the diameter of the phosphor particles.

As a result, it can be seen that when the second dispersion is performed with zirconia as the dispersion medium aggregates can be dispersed without grinding the phosphor particles themselves.

Also from Table 11, it can be seen that the luminance does not decrease as the dispersion time increases. This is because the second dispersion is performed using zirconia beads as the dispersing medium, which limits the damage to the surfaces of the phosphor particles.

Modifications to the First to Third Embodiments

The above embodiments describe the case where the phosphor particles are directly applied to the channels between the partition walls. However, the invention may be modified so that an ink containing a reflective material is applied in the channels and the phosphor layers are formed on top of this.

In other words, the above ink application apparatus maybe used to apply a reflective material ink and phosphor inks to form a reflective layer and the phosphor layers 31.

The reflective material ink is a composite of a reflective material, a binder, and a solvent. Highly reflective white particles such as titanium oxide or alumina can be used as the reflective material, with it being especially preferable to use titanium oxide with an average particle diameter of 5 $\mu$m or less.

The above embodiments describe the case when the invention is used for an AC-type PDP, though this is not a limit for the present invention, which may be widely used in any kind of PDP that has partition walls formed in stripes and phosphor layers formed between the partition walls.

Industrial Applicability

PDPs that are manufactured by the manufacturing method or manufacturing apparatus of the present invention are suited to use as display apparatuses, such as computer monitors or televisions, and in particular to use as large-scale display apparatuses.

What is claimed is:

1. A manufacturing method of a plasma display panel, comprising:

a phosphor ink applying step in which a nozzle expels a continuous stream of phosphor ink onto channels each of which are formed between adjacent partition walls on a first plate, and the nozzle and the plate moving relatively to each other so that the nozzle scans the channels; and a sealing step in which a second plate is placed on the partition walls of the first plate, the first and second plates are sealed together, and a gas medium is introduced between the first and second plates, wherein the phosphor ink applying step comprising:

a first substep in which a width of each channel is measured longitudinally along the channel before the phosphor ink is applied to the channel; and a second substep in which the phosphor ink is applied by expelling the phosphor ink from the nozzle while adjusting the amount of phosphor ink applied per unit length of the partition walls in accordance with the width of the channel measured in the first substep.

2. A manufacturing method according to claim 1, wherein at least one of (1) an amount of phosphor ink expelled from the nozzle per unit time, and (2) a scanning speed of the nozzle is adjusted in the second substep in accordance with the width measured in the first substep.

3. A phosphor ink applying apparatus including an ink expelling means that has a nozzle expel a continuous stream of phosphor ink onto channels, each of which is formed between adjacent partition walls on a plate for use in a plasma display panel, the nozzle and the plate moving relatively to each other so that the nozzle scans the channels, the ink expelling means comprising:

a channel width measuring unit for measuring longitudinally a width of each channel between a pair of adjacent partition walls; and an expelled ink amount adjusting means for adjusting an amount of phosphor ink expelled per unit length of the partition walls in accordance with the width of the channel measured by the channel width measuring unit.

4. An phosphor ink applying apparatus in accordance with claim 3, wherein the expelled ink amount adjusting means adjusts the amount of phosphor ink expelled per unit length of the partition walls by adjusting at least one of (1) an amount of phosphor ink expelled from the nozzle per unit time, and (2) a scanning speed of the nozzle.

* * * * *